US008564510B2

(12) United States Patent
Min et al.

(10) Patent No.: US 8,564,510 B2
(45) Date of Patent: Oct. 22, 2013

(54) DISPLAY DEVICE AND DRIVING METHOD THEREOF

(75) Inventors: Ung-Gyu Min, Namyangju (KR); Oh-Kyong Kwon, Seoul (KR)

(73) Assignees: Samsung Display Co., Ltd., Yongin (KR); Industry-University Cooperation Foundation Hanyang University, Seoul (KR)

( * ) Notice: Subject to any disclaimer, the term of this patent is extended or adjusted under 35 U.S.C. 154(b) by 867 days.

(21) Appl. No.: 12/494,823

(22) Filed: Jun. 30, 2009

(65) Prior Publication Data

US 2010/0188320 A1 Jul. 29, 2010

(30) Foreign Application Priority Data

Jan. 23, 2009 (KR) ..... 10-2009-0006325

(51) Int. Cl.
*G09G 3/30* (2006.01)

(52) U.S. Cl.
USPC ..... 345/80; 345/76; 345/77; 345/87

(58) Field of Classification Search
USPC ..... 345/36, 44–46, 76–80
See application file for complete search history.

(56) References Cited

U.S. PATENT DOCUMENTS

| | | | | |
|---|---|---|---|---|
| 7,956,832 | B2 * | 6/2011 | Tanaka et al. | 345/87 |
| 2006/0238461 | A1 * | 10/2006 | Goh et al. | 345/76 |
| 2006/0290613 | A1 * | 12/2006 | Hong et al. | 345/76 |
| 2008/0143648 | A1 * | 6/2008 | Ishizuka et al. | 345/76 |
| 2008/0150934 | A1 * | 6/2008 | Ozaki et al. | 345/214 |
| 2008/0180365 | A1 * | 7/2008 | Ozaki | 345/76 |
| 2009/0135107 | A1 * | 5/2009 | Kim | 345/76 |
| 2009/0244043 | A1 * | 10/2009 | Kasai et al. | 345/211 |

* cited by examiner

*Primary Examiner* — Amare Mengistu
*Assistant Examiner* — Sarvesh J Nadkarni
(74) *Attorney, Agent, or Firm* — H.C. Park & Associates, PLC

(57) ABSTRACT

The present invention relates to a structure and a method of a pixel and a data driver to measure degradation of an organic light emitting element, and a threshold voltage and mobility of a driving transistor in an organic light emitting device such that degradation of the organic light emitting element and the threshold voltage and mobility of the driving transistor are measured in a turn-on interval of the display device and a data voltage applied to the pixel is amended, and thereby images of improved and uniform quality may be displayed.

16 Claims, 15 Drawing Sheets

DISPLAY DEVICE AND DRIVING METHOD THEREOF

CROSS REFERENCE TO RELATED APPLICATION

This application claims priority from and the benefit of Korean Patent Application No. 10-2009-0006325, filed on Jan. 23, 2009, which is hereby incorporated by reference for all purposes as if fully set forth herein.

BACKGROUND OF THE INVENTION

1. Field of the Invention

The present invention relates to a display device and a driving method thereof, and particularly to an organic light emitting device and a driving method thereof.

2. Discussion of the Background

A hole-type flat panel display such as an organic light emitting device displays a fixed picture for a predetermined time period, for example for a frame, regardless of whether it is a still picture or a motion picture. As an example, when some continuously moving object is displayed, the object stays at a specific position for a frame and then stays at a next position to which the object was moved after a time period of a frame in a next frame, i.e., movement of the object is discretely displayed. Since an afterimage is maintained within one frame, the motion of the object is displayed as continuous when it is displayed through the above-noted method.

However, when a user views the moving object on the screen, since the user's eyes continue to move as the object moves, screen displaying appears blurred by the mismatched displaying with the discrete displaying method by the display device. For example, assuming that the display device displays that an object stays at a position A in the first frame and it stays at a position B in the second frame, the user's eyes move along the object's expected moving path from the position A to the position B in the first frame. However, the object is not actually displayed at intermediate positions other than the positions A and B.

Resultantly, the object appears blurred since the luminance sensed by the user during the first frame is acquired by integrating the luminance of pixels on the path between the positions A and B, that is, the average of the luminance of the object and the luminance of the background.

Since the degree of blurring of the hole-type display device is in proportion to the time for the display device to maintain displaying, an impulse drive method for displaying the image for a predetermined time within one frame and displaying black for the rest of the time has been proposed. In this method, since the time for displaying the image is reduced to decrease the luminance, a method for increasing the luminance during the time of displaying or displaying an intermediate luminance with a neighboring frame other than black has been proposed. However, this method increases power consumption and increases drive complexity.

A pixel of the organic light emitting device includes an organic light emitting element and a thin film transistor (TFT) for driving the organic light emitting element, and when they are operated for a long time, the threshold voltage is varied so that the expected luminance may not be output, and when the characteristic of a semiconductor included in the thin film transistor is not uniform in the display device, luminance deviation between the pixels may occur.

SUMMARY OF THE INVENTION

Exemplary embodiments of the present invention provide a device to measure the threshold voltage and the mobility of the driving transistor and the degradation of the organic light emitting element in the organic light emitting device and to amend the data by using the measurement results to provide constant luminance.

Additional features of the invention will be set forth in the description which follows, and in part will be apparent from the description, or may be learned by practice of the invention.

An exemplary embodiment of the present invention discloses a display device including a data driver and a plurality of data lines connected to the data driver. A pixel is connected to each data line, and displays images. The pixel includes a light-emitting element including a first terminal and a second terminal, a driving transistor to output a driving current to drive the light-emitting element, and including a control terminal, an input terminal, and an output terminal. A first switching transistor controlled by a first scanning signal, is connected between the respective data line and the control terminal of the driving transistor. A second switching transistor controlled by a second scanning signal, is connected between the respective data line and the output terminal of the driving transistor. A third switching transistor controlled by a third scanning signal, is connected between the output terminal of the driving transistor and the first terminal of the light-emitting element. A capacitor is connected between the control terminal of the driving transistor and a driving voltage terminal. The data driver is configured to apply a data voltage to the pixel through the respective data line and the data driver includes a mode selector to select to receive a sensing data voltage from the pixel.

An exemplary embodiment of the present invention also discloses a method for driving a display device. The display device has a display panel including a pixel. The pixel includes a driving transistor and a light-emitting element. A data line is connected to the pixel. The method includes executing at least one of determining a threshold voltage of the driving transistor, determining a mobility of the driving transistor, and determining a degradation of the light-emitting element; and amending and converting the input data into a data voltage based on the determining result to apply the data voltage to the pixel according to the data line. The data line is used to measure the voltage in the determining of the threshold voltage and the mobility of the driving transistor, and the degradation of the light-emitting element.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
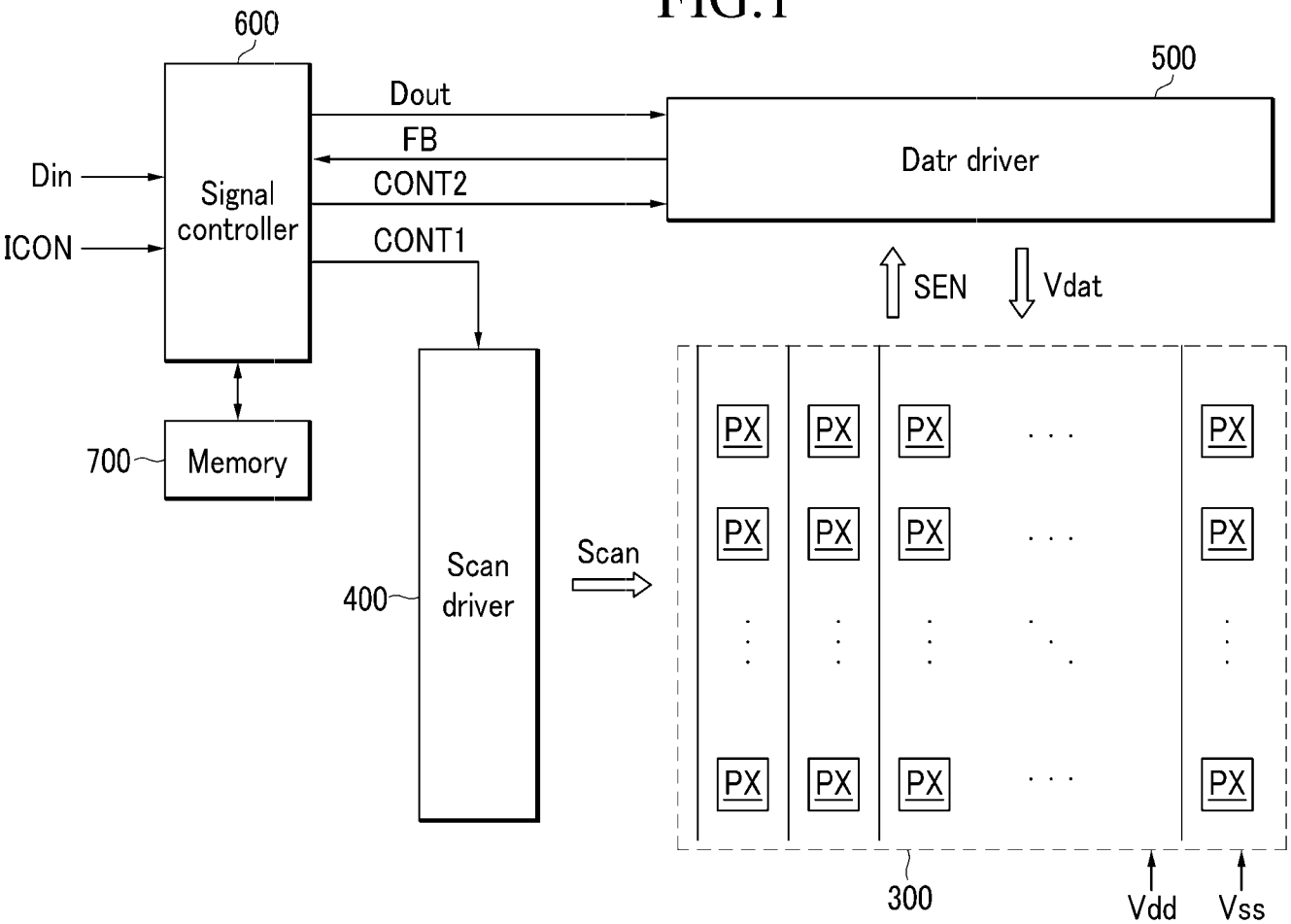
FIG. 1 shows a block diagram of an organic light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

An organic light emitting device according to an exemplary embodiment of the present invention will now be described with reference to FIG. 1 and FIG. 2.

Figure 2:
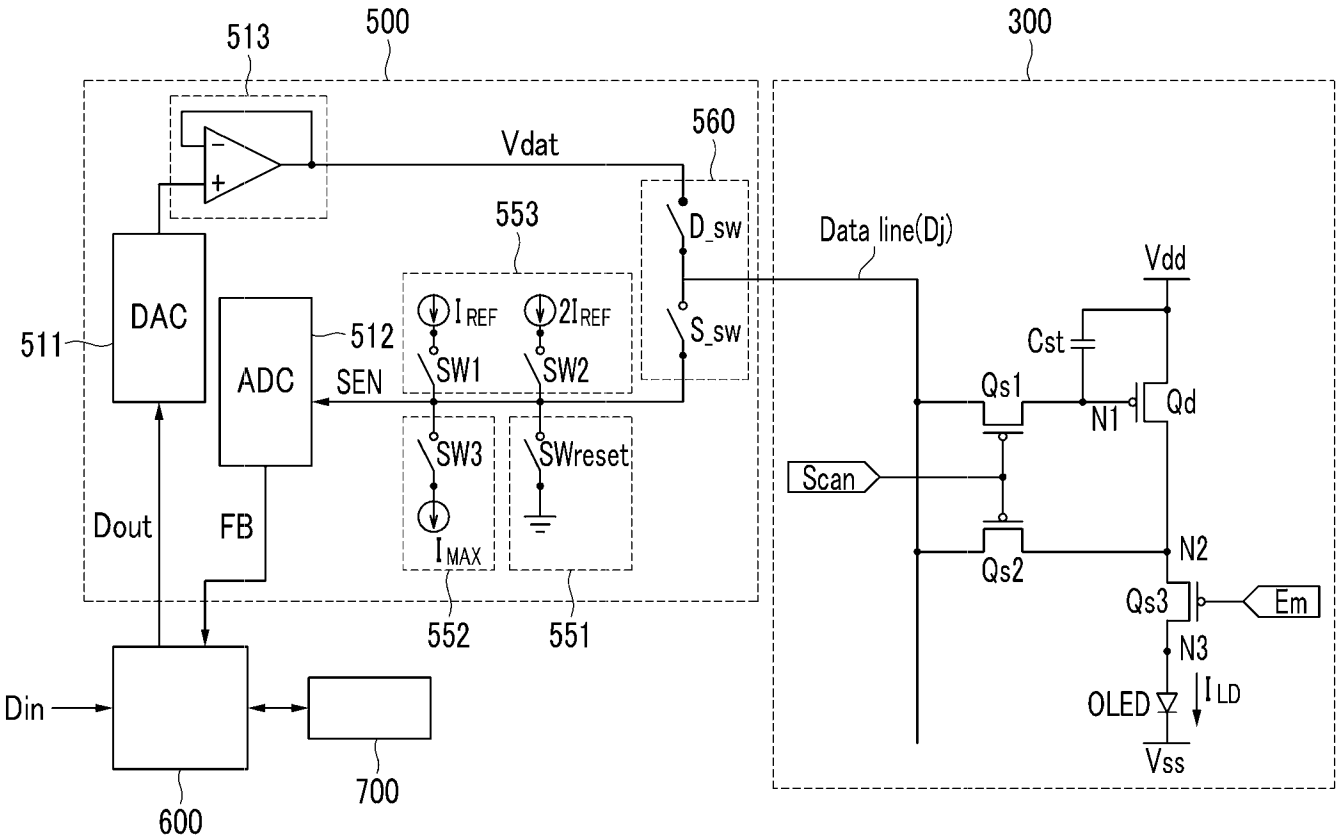
FIG. 2 shows an equivalent circuit diagram of a pixel in an organic light emitting device according to an exemplary embodiment of the present invention, along with a data driver, a signal controller, and a memory.

FIG. 1 shows a block diagram of an organic light emitting device according to an exemplary embodiment of the present invention, and FIG. 2 shows an equivalent circuit diagram of a pixel in an organic light emitting device according to an exemplary embodiment of the present invention, along with a data driver, a signal controller, and a memory.

Referring to FIG. 1, the organic light emitting device includes a display panel 300, a scan driver 400, a data driver 500, a signal controller 600, and a memory 700.

The display panel 300 includes a plurality of signal lines (not shown), a plurality of voltage lines (not shown), and a plurality of pixels PX connected thereto and substantially arranged as a matrix.

The signal lines include a plurality of scanning signal lines to transmit scanning signals, and a plurality of date lines to transmit data voltages Vdat and to sense data signals SEN. The scanning signal lines are extended in approximately a row direction and are substantially parallel to each other, and the data lines are extended in approximately a column direction and are substantially parallel to each other.

The voltage lines include a driving voltage line (not shown) to transmit a driving voltage Vdd.

As shown in FIG. 2, the pixel PX includes an organic light emitting element OLED, a driving transistor Qd, a capacitor Cst, and a first switching transistor Qs1, a second switching transistor Qs2 and a third switching transistor Qs3.

The driving transistor Qd has an output terminal, an input terminal, and a control terminal. The control terminal of the driving transistor Qd is connected to the capacitor Cst and the first switching transistor Qs1 at a node N1, the input terminal thereof is connected to the driving voltage Vdd, and the output terminal thereof is connected to the second switching transistor Qs2 and the third switching transistors Qs3 at a node N2.

A first terminal of the capacitor Cst is connected at the node N1 to the driving transistor Qd, and a second terminal of the capacitor Cst is connected to the driving voltage Vdd.

The first switching transistor Qs1 is operated in response to a first scanning signal Scan, the second switching transistor Qs2 is also operated in response to the first scanning signal Scan, and the third switching transistor Qs3 is operated in response to a second scanning signal Em. The first switching transistor Qs1 is connected between the data line Dj and the node N1, the second switching transistor Qs2 is connected between the data line Dj and the node N2, and the third switching transistor Qs3 is connected between the anode (i.e., node N3) of the organic light emitting element OLED and the node N2.

In the present exemplary embodiment, the driving transistor Qd and the first switching transistor Qs1, the second switching transistor Qs2 and the third switching transistor Qs3 are p-channel electric field effect transistors, and an example of the electric field effect transistor can be a thin film transistor (TFT) and it may include polysilicon or amorphous silicon. A low voltage Von may turn on the first switching transistor Qs1, the second switching transistor Qs2 and the third switching transistor Qs3, and a high voltage Voff may turn off the first switching transistor Qs1, the second switching transistor Qs2 and the third switching transistor Qs3.

An anode of the organic light emitting element OLED is connected to the third switching transistor Qs3, and a cathode thereof is connected to a common voltage Vss. The organic light emitting element OLED displays images by emitting light by varying the intensity according to the current $I_{LD}$ supplied by the driving transistor Qd through the third switching transistor Qs3, and the current $I_{LD}$ depends on the voltage between the control terminal and the input terminal of the driving transistor Qd.

Referring to FIG. 2, the data driver 500 includes constituent elements as follows.

Basically, a digital-to-analog converter 511, an analog-to-digital converter 512, and an OP amplifier 513 are included in the data driver 500. The digital-to-analog converter 511 receives digital output image signals Dout of the display pixels PX for each row to convert them into analog voltages and to apply the converted analog voltages to the OP amplifier 513 such that the OP amplifier 513 amplifies the converted analog voltages into non-inversion voltages and applies them to the data lines D1-Dm as analog data voltages Vdat. On the other hand, the analog-to-digital converter 512 receives sensing data signals SEN from each display pixel PX through the data lines Dj and converts them into digital values (i.e., digital sensing data signal FB) and outputs them.

On the other hand, the data driver 500 additionally includes a threshold voltage sensor 551 to sense a threshold voltage, a mobility sensor 552 to sense a mobility, and a degradation sensor 553 to sense a degradation of the organic light emitting element OLED. The threshold voltage sensor 551 includes a ground terminal and a reset switch SWreset to control the switching, and the mobility sensor 552 includes a third switch SW3 to control connection with a current source discharging a maximum current $I_{MAX}$. Also, the degradation sensor 553 includes a first switch SW1 connected to current source $I_{REF}$ to control the connection to the current source $I_{REF}$ and a second switch SW2 connected to current source $2I_{REF}$ to control the connection to the current source $2I_{REF}$.

Also, the data driver 500 further includes a mode selector 560. The mode selector 560 includes a data line selection switch D_sw for the data driver 500 to apply the data voltage Vdat to the data line, and a sensing line selection switch S_sw for the data driver 500 to receive the sensing data signal SEN through the data line. That is, the data driver 500 includes a data line selection switch D_sw to apply the data voltage Vdat to the data line Dj through the digital-to-analog converter 511 and the OP amplifier 513, and a sensing line selection switch S_sw connecting the sensing data voltage from the data line Dj to the analog-to-digital converter 512 through the threshold voltage sensor 551, the mobility sensor 552, and the degradation sensor 553. According to the operation of the data line selection switch D_sw and the sensing line selection switch S_sw, one data line Dj executes the function as the data line applying the data voltage Vdat or as the sensing line sensing the voltage of the specific voltage of the pixel.

The signal controller 600 controls the operations of the scan driver 400 and the data driver 500, and receives the digital sensing data signal FB to amend the input image signal Din according to characteristics (threshold voltage and mobility) of the driving transistor Qd and the characteristic (degree of degradation) of the organic light emitting element OLED and to output the output image signal Dout. Here, the signal controller 600 amends the input image signals Din by using characteristic data and a lookup table stored in the memory 700, and the memory 700 is formed on the outside of the signal controller 600, however it may be formed inside the signal controller 600

The memory 700 stores the data (the data for the threshold voltage, the mobility, and the degradation) detected in the pixels PX, and the lookup table corresponding to the detected data.

Each of the drivers 400, 500, and 600 may be directly mounted on the liquid crystal panel assembly 300 in the form of at least one IC chip, may be mounted on a flexible printed circuit film (not shown) and then mounted on the liquid crystal panel assembly 300 in the form of a tape carrier package (TCP), or may be mounted on a separate printed circuit board (not shown). Alternatively, the drivers 400, 500, and 600 may be integrated with the liquid crystal panel assembly 300 together with, for example, the signal lines and the transistors Qs1-Qs3 and Qd. The drivers 400, 500, and 600 may be integrated into a single chip. In this case, at least one of the drivers or at least one circuit forming the drivers may be arranged outside the single chip.

Next, a method for measuring a threshold voltage Vth and a mobility μ of the driving transistor Qd, and degradation of an organic light emitting element OLED, will be described in the organic light emitting device according to an exemplary embodiment of the present invention.

Firstly, a method for measuring degradation of an organic light emitting element OLED according to an exemplary embodiment of the present invention will be described with reference to FIG. 3.

Figure 3:
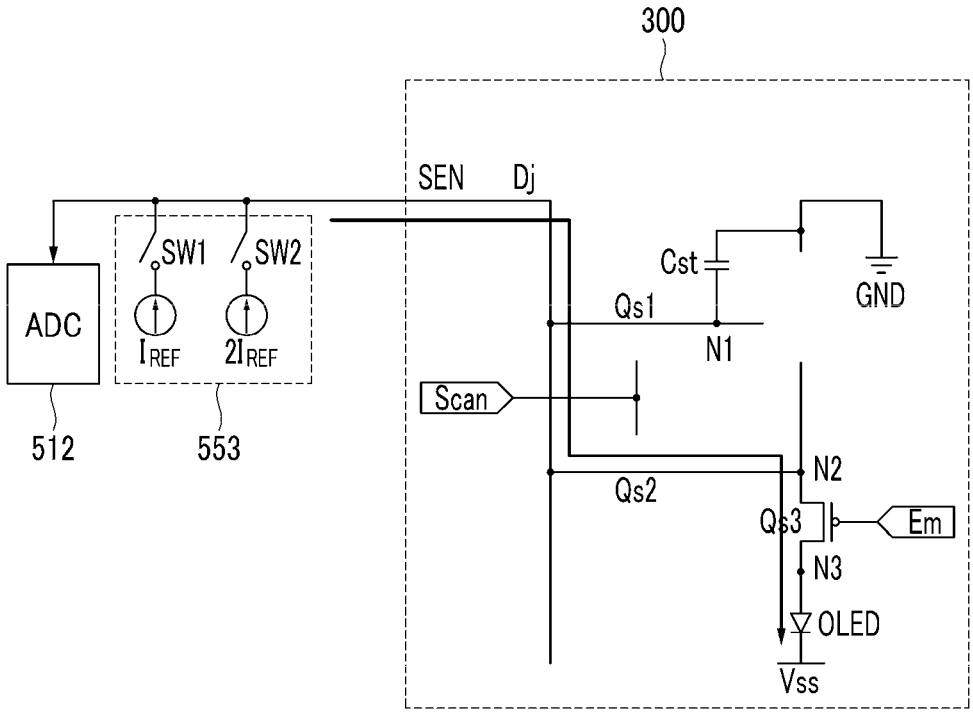
FIG. 3 is an equivalent circuit diagram when measuring degradation of an organic light emitting element through the exemplary embodiment shown in FIG. 2.

FIG. 3 is an equivalent circuit diagram when measuring the degradation of the organic light emitting element OLED through the exemplary embodiment shown in FIG. 2.

In the organic light emitting device of FIG. 2, the sensing line selection switch S_sw is maintained in an on state, and the data line selection switch D_sw is maintained in an off state. Also, a reset switch SWreset of the threshold voltage sensor 551 and the third switch SW3 of the mobility sensor 552 are maintained in the off state. Also, the first scanning signal Scan and second scanning signal Em are applied with the low voltage Von. On the other hand, although any voltage is applied to the control terminal of the driving transistor Qd, the input terminal of the driving transistor Qd that is applied with the driving voltage Vdd is grounded for the driving transistor Qd to be maintained in the off state. The driving transistor Qd is operated by a voltage difference between the input terminal and the control terminal, but is not operated when the voltage of the control terminal is higher than the voltage of the input terminal. Therefore, if the voltage is decreased by grounding the input terminal, the voltage of the control terminal is higher than the voltage of the input terminal such that the driving transistor Qd is not operated. Through this application, the structure shown in FIG. 3 is formed.

Here, the first and second switches SW1 and SW2 respectively connected to the two current sources $I_{REF}$ and $2I_{REF}$ included in the degradation sensor 553 are sequentially operated. Thus, the current is applied in the current source such that the current flows in the arrow direction of FIG. 3, and the voltage of the node N2 is measured. To measure the voltages of two current sources involves calculating the voltage (the voltage of the node N3) of the anode of the organic light emitting element OLED from the voltage of the node N2. In the exemplary embodiment of the present invention, the voltage of the node N2 is measured, and the voltage (the voltage of the node N3) of the anode of the organic light emitting element OLED may be measured. In the present exemplary embodiment, the voltage of the node N2 that is not the voltage of the node N3 is measured such that it is necessary to consider the voltage drop generated in the third switching transistor Qs3. Also, although the voltage drop is slightly generated in the second switching transistor Qs2, it is necessary to consider this. At least two current sources are required to calculate this voltage drop. However, an additional current source may be further formed according to an exemplary embodiment. The present exemplary embodiment has the reference current $I_{REF}$ and the reference current $2I_{REF}$ that is two times the reference current $I_{REF}$. However, the reference currents may have various current values and the additional current source may also have various current values.

As above-described, the degradation degree of the organic light emitting element OLED is determined with reference to the voltage of the node N3 that is calculated by considering the voltage drop. That is, the degradation is determined by comparing the voltage of the node N3 and the luminance of the light emitted from the organic light emitting element OLED. This determination process may use the lookup table stored in the memory 700. Also, the degradation must be compensated when generating the luminance, and the compensation degree may be determined by using the lookup table.

As shown in FIG. 3, the degradation of the organic light emitting element OLED may be measured in the case that the third switching transistor Qs3 is in the on state. Also, the application of the sensing voltage and the data voltage are both executed by using the data line Dj in turn such that the data voltage is not applied when the sensing line selection switch S_sw is in the on state.

Now, a method for measuring the threshold voltage Vth of the driving transistor Qd will be described with reference to FIG. 4.

Figure 4:
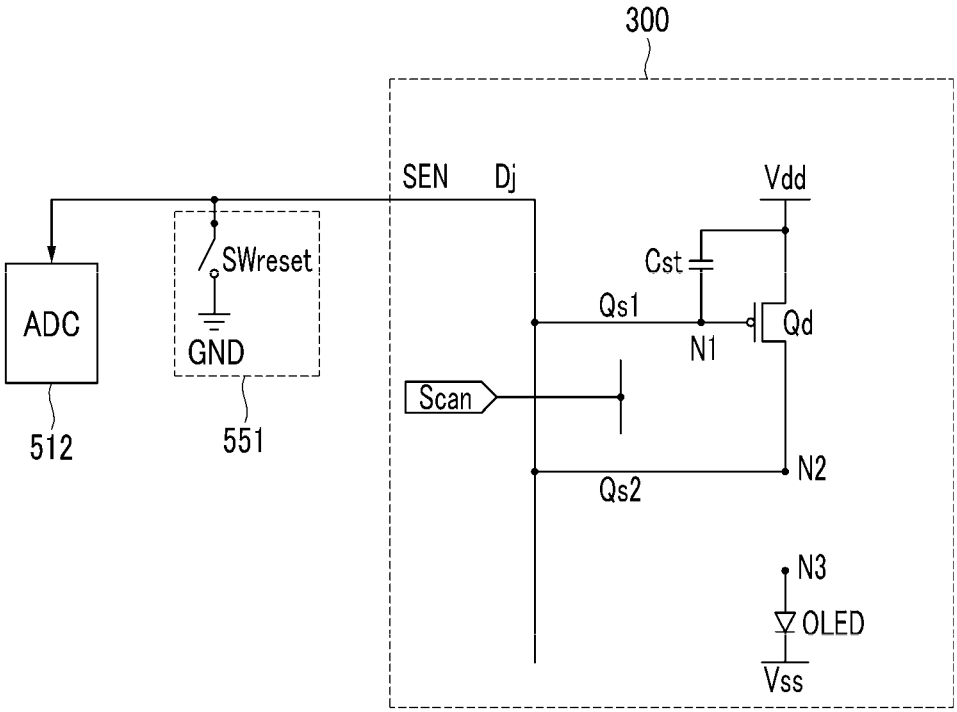
FIG. 4 is an equivalent circuit diagram when measuring a threshold voltage of a driving transistor of an organic light emitting device through the exemplary embodiment shown in FIG. 2.

FIG. 4 is an equivalent circuit diagram when measuring the threshold voltage Vth of the driving transistor Qd of the organic light emitting device through the exemplary embodiment shown in FIG. 2.

In the organic light emitting device of FIG. 2, the sensing line selection switch S_sw is maintained in the on state, the data line selection switch D_sw is maintained in the off state, and the third switch SW3 of the mobility sensor 552 and the first switch SW1 and the second switch SW2 of the degradation sensor 553 are maintained in the off state. Also, the first scanning signal Scan is applied with the low voltage Von, and the second scanning signal Em is applied with the high voltage Voff. Through this application, the structure shown in FIG. 4 is formed. Here, the driving transistor Qd is diode-connected. Here, the reset switch SWreset of the threshold voltage sensor 551 is turned on during a predetermined time and is turned off to measure the threshold voltage, that is, the voltage of the node N1. If the reset switch SWreset is turned on, the voltage of the node N1 is a ground as 0, and if the reset switch SWreset is turned off, the voltage of the node N1 is slowly increased. In the present exemplary embodiment, the node N1 is connected to the ground by the reset switch SWreset, however a DC voltage that is sufficiently lower than the driving voltage Vdd may be used according to an exemplary embodiment. After a predetermined time, the increasing of the voltage slows and the voltage of a constant degree is represented. This substantially constant voltage is the value of the difference of the threshold voltage Vth of the diode-connected driving transistor Qd from the driving voltage Vdd that is a voltage of the input terminal of the driving transistor Qd. Therefore, after the reset switch SWreset is turned off, if the voltage of the node N1 is measured after the predetermined time that the driving transistor Qd arrives at the threshold voltage Vth, the voltage of the difference of the threshold voltage Vth from the driving voltage Vdd such that the threshold voltage Vth may be obtained by subtracting the voltage of the node N1 from the voltage Vdd.

$$V_N = Vdd - |Vth| \quad \text{[Equation 1]}$$

Here, the $V_N$ is a voltage of the node N1 when measuring the threshold voltage.

Only the threshold voltage Vth may be stored or processed as it is as the voltage that is stored to the memory 700 or is processed in the signal controller 600, however the voltage value measured at the node N1 $V_N$ may be stored to the memory 700 or may be processed in the signal controller 600. When using the voltage measured at the node N1 $V_N$, a step for calculating the threshold voltage Vth may be eliminated such that a simple circuit may be manufactured.

On the other hand, the time that the voltage of the node N1 is measured may be calculated from the time that the reset switch SWreset is turned off, and the time may have a different value according to the characteristics of the display panel and may be determined when manufacturing the display panel.

Also, as shown in FIG. 4, it is possible to measure the voltage of the node N1 when the third switching transistor Qs3 is in the off state. Also, the applications of the sensing voltage and the data voltage are executed by using the data line Dj such that the data voltage is not applied when the sensing line selection switch S_sw is in the on state.

Next, a method for measuring the mobility μ of the driving transistor Qd according to an exemplary embodiment of the present invention will be described with reference to FIG. 5.

Figure 5:
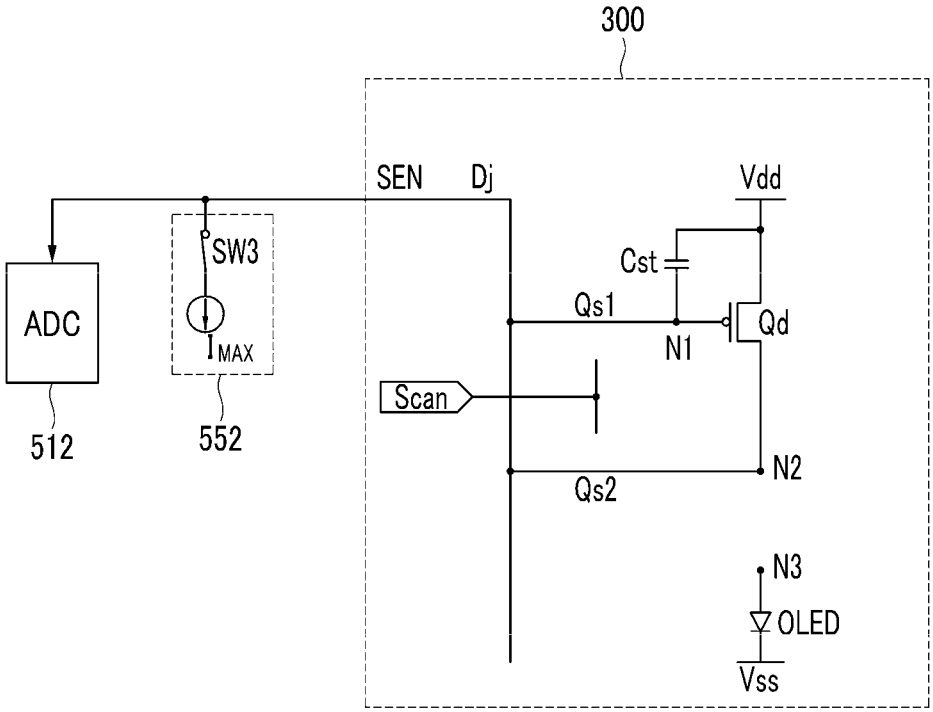
FIG. 5 is an equivalent circuit diagram when measuring mobility of a driving transistor through the exemplary embodiment shown in FIG. 2.

FIG. 5 is an equivalent circuit diagram when measuring the mobility μ of the driving transistor Qd through the exemplary embodiment shown in FIG. 2.

In the organic light emitting device of FIG. 2, the sensing line selection switch S_sw is maintained in the on state, the data line selection switch D_sw is maintained in the off state, and the reset switch SWreset of the threshold voltage sensor 551 and the first switch SW1 and the second switch SW2 of the degradation sensor 553 are maintained in the off state. Also, the first scanning signal Scan is applied with the low voltage Von, and the second scanning signal Em is applied with the high voltage Voff. Through this application, the structure shown in FIG. 5 is formed. Here, the driving transistor Qd is diode-connected. Here, the voltage of the node N1 is measured in the state that the third switch SW3 of the mobility sensor 552 is turned on to constantly flow a maximum current $I_{MAX}$ outside such that the mobility μ may be obtained.

The method of obtaining the mobility μ will be described as follows.

Firstly, a current flowing in the driving transistor Qd may be represented as Equation 2.

$$I = \frac{1}{2}\mu C_{ox}\frac{W}{L}(V_{SG} - |V_{th}|)^2 \quad \text{[Equation 2]}$$

Here, μ is an electric field effect mobility, $C_{ox}$ is a capacity of a gate insulating layer per unit area, W is a width of the channel of the driving transistor Qd, L is a length of the channel of the driving transistor Qd, $V_{SG}$ is a voltage difference between the control terminal and the input terminal of the driving transistor Qd, and Vth is the threshold voltage of the driving transistor Qd.

In FIG. 5, the current flowing in the driving transistor Qd is the maximum current $I_{MAX}$, and $V_{SG}$ may be rewritten as Equation 3.

$$I_{MAX} = \frac{1}{2}\mu C_{ox}\frac{W}{L}(V_{dd} - V_G - |V_{th}|)^2 \quad \text{[Equation 3]}$$

Equation 3 may be summarized with reference to the voltage $V_G$ (a voltage of the control terminal of the driving transistor Qd is the value when the maximum current is flowed, and is represented as $V_{GMAX}$ in Equation 4) as Equation 4 below.

$$V_{GMAX} = V_{dd} - |V_{th}| - \sqrt{\frac{2I_{MAX} \times L}{\mu C_{ox} \times W}} \quad \text{[Equation 4]}$$

Here, $V_{GMAX}$ is the voltage measured at the node N1 when measuring the mobility μ in FIG. 5, Vdd−|Vth| is a voltage $V_N$ measured at the node N1 when measuring the threshold voltage Vth in FIG. 4, and $C_{ox}$, W, L, and $I_{MAX}$ are known such that the mobility μ may be obtained.

Only the mobility μ may be stored or processed as it is as the data that is stored to the memory 700 or the mobility μ is processed in the signal controller 600, however the voltage value measured at the node N1 may be stored to the memory 700 or may be processed in the signal controller 600. When using the voltage measured at the node N1, a step for calculating the mobility μ may be eliminated such that a simple circuit may be manufactured.

Also, like the case of measuring the threshold voltage Vth of FIG. 4, it is also possible to measure the voltage of the node N1 in FIG. 5 when the third switching transistor Qs3 is in the off state. Also, the applications of the sensing voltage and the data voltage are executed by using the data line Dj such that the data voltage is not applied when the sensing line selection switch S_sw is in the on state.

As above-described, the measurement of the threshold voltage Vth, the mobility μ, and the degradation of the organic light emitting element OLED may be firstly executed at the turn-on interval after the turn-on of the display device before the display of the pixel. Also, the operation of the display of the images is executed in the frame interval. This will be described with reference to FIG. 6, FIG. 7 and FIG. 8.

Figure 6:
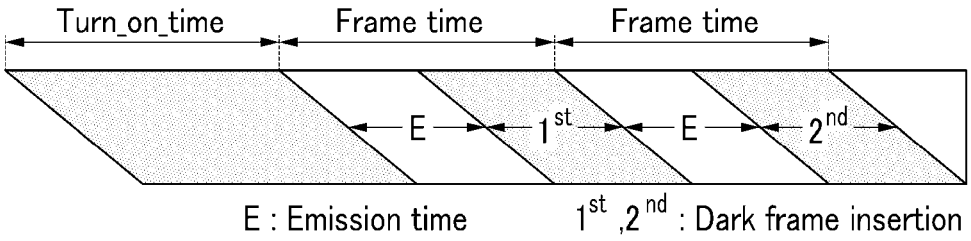
FIG. 6 is a view showing a turn-on interval and a frame interval of the organic light emitting device shown in FIG. 2.

Firstly, FIG. 6 shows a turn-on interval and a frame interval in the organic light emitting device.

FIG. 6 is a view showing a turn-on interval and a frame interval of the organic light emitting device shown in FIG. 2.

The turn-on interval (a turn-on time) is an interval after the application of the power to the organic light emitting device and before the display of the images of the display device. In this turn-on interval, it is possible to measure the threshold voltage Vth and the mobility μ of the driving transistor Qd.

The frame interval (a frame time) as an interval in which the organic light emitting device displays the images via the luminance according to the input data. An exemplary embodiment of the present invention is impulse driven such that a black interval (dark frame insertion) displaying a black color during a predetermined time of one frame exists. The remaining time except for the black interval during the frame interval is an emission interval (an emission time) in which the organic light emitting element emits the light. In one frame interval, the ratio of the black interval and the emission interval may be variously determined. That is, the black interval and the emission interval may be the same length of time, or the emission interval may be longer or shorter than the black interval. However, when the black interval is longer, a drawback occurs in that the luminance of the display device may be decreased.

In this frame interval, the data voltage Vdat is continuously applied through the data line Dj such that the measurements of the degradation of the organic light emitting element OLED, and the threshold voltage Vth and the mobility μ of the driving transistor Qd are executed at the turn-on interval when the data voltage is not applied through the data line Dj.

However, when the data line Dj for application of the data voltage and the sensing line Sj (FIG. 12) for the measurements of the degradation of the organic light emitting element OLED, and the threshold voltage Vth and the mobility μ of the driving transistor Qd are separated from each other, these measurements may be executed in the frame interval. Next, FIG. 7 shows a waveform when measuring the degradation of the organic light emitting element OLED, and the threshold voltage Vth and mobility μ of the driving transistor Qd in the turn-on interval, and FIG. 8 shows a waveform when the pixels display the images in the frame interval.

Firstly, FIG. 7 will be described.

Figure 7:
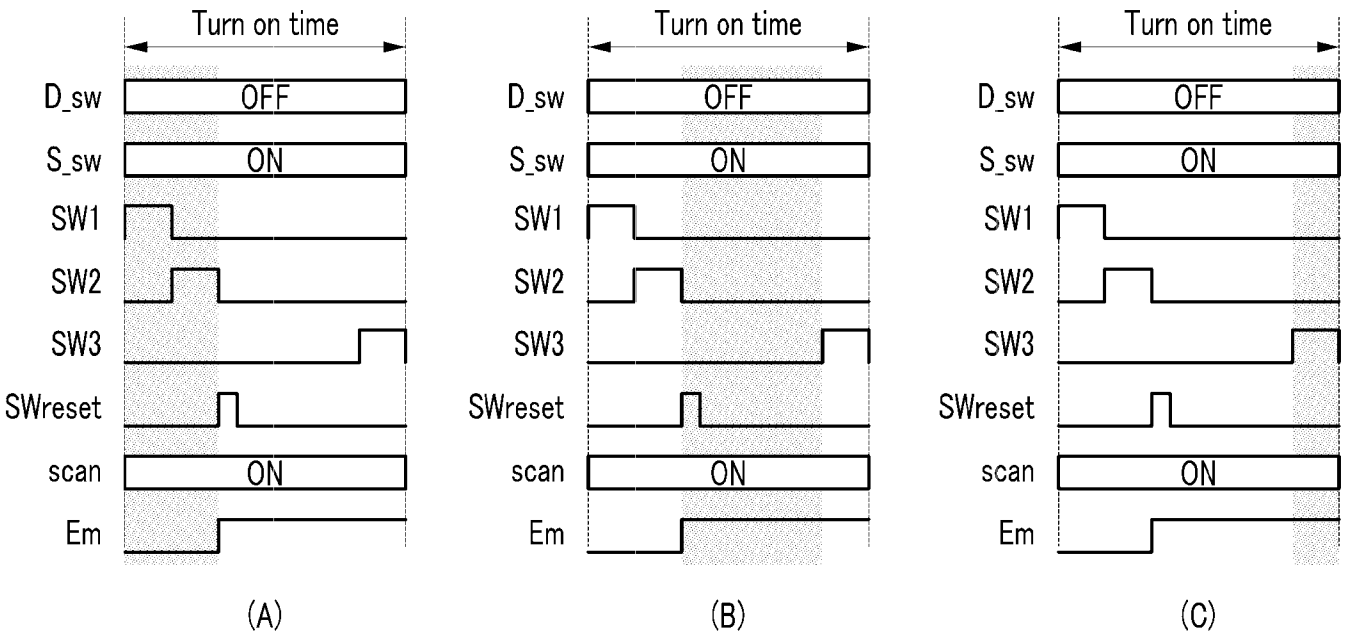
FIG. 7 is a waveform diagram of a signal applied when measuring a threshold voltage and mobility of the driving transistor shown in FIG. 2 in the turn-on interval of FIG. 6.
Figure 8:
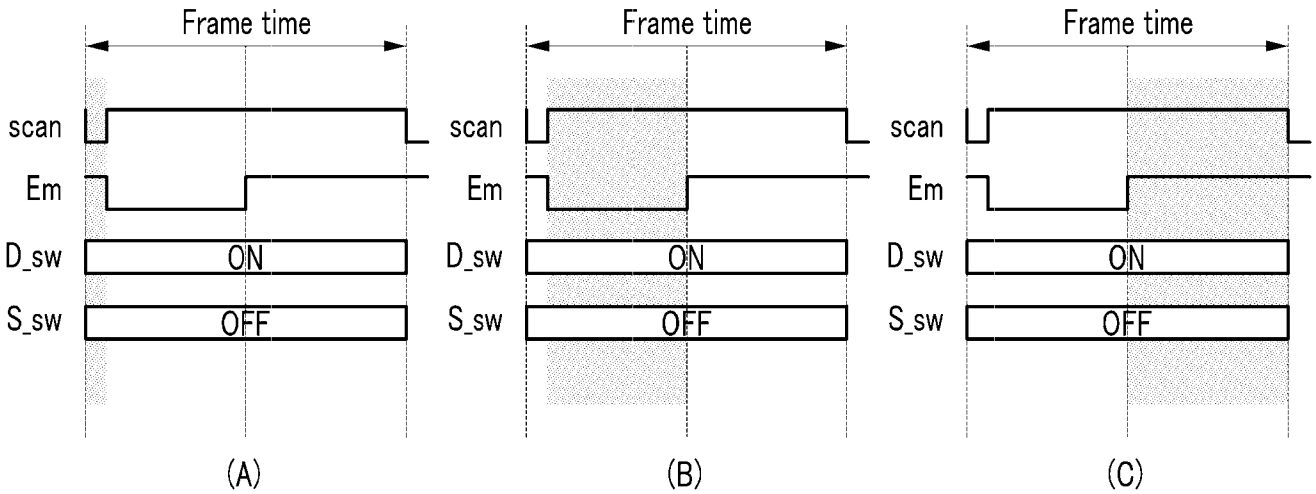
FIG. 8 is a waveform diagram of a signal applied to emit light from the organic light emitting device shown in FIG. 2 in the frame interval of FIG. 6.

FIG. 7 is a waveform diagram of a signal applied when measuring the degradation of the organic light emitting element OLED and the threshold voltage Vth and the mobility μ of the driving transistor Qd shown in FIG. 2 in the turn-on interval of FIG. 6. FIG. 7(A) shows the interval for measuring the degradation of the organic light emitting element OLED, FIG. 7(B) shows the interval for measuring the threshold voltage Vth, and FIG. 7(C) shows the interval for measuring the mobility μ.

Firstly, as shown in FIG. 7(A), to measure the degradation of the organic light emitting element OLED, the sensing line selection switch S_sw is maintained in the on state to receive the detection signal from the data line Dj, and the switches including the data line selection switch D_sw of the mode selector 560, the reset switch SWreset of the threshold voltage sensor 551 and the third switch SW3 of the mobility sensor 552 are maintained in the off state. Also, the first scanning signal Scan is applied with the low voltage Von, and the third scanning signal Em is also applied with the low voltage Von. In this state, the first switch SW1 and the second switch SW2 included in the degradation sensor 553 are sequentially turned on to measure the voltages of the node N2 such that the voltage of the node N3 (i.e., the voltage of the anode of the organic light emitting element OLED) is calculated to determine the degradation of the organic light emitting element OLED. The determination of the existence of the degradation may be executed with reference to the lookup table stored in the memory 700.

On the other hand, as shown in FIG. 7(B), to measure the threshold voltage Vth of the driving transistor Qd, the sensing line selection switch S_sw is maintained in the on state to receive the detection signal from the data line Dj, and the switches including the data line selection switch D_sw of the mode selector 560, the third switch SW3 of the mobility sensor 552 and the first switch SW1 and the second switch SW2 of the degradation sensor 553 are all maintained in the off state. Also, the first scanning signal Scan is applied with the low voltage Von, and the third scanning signal Em is applied with the high voltage Voff. In this state, the reset switch SWreset included in the threshold voltage sensor 551 is temporary turned on and then turned off, and the voltage of the node N1 is measured after the passage of the time from the turn-off time to calculate the threshold voltage Vth.

Also, as shown in FIG. 7(C), to measure the mobility μ of the driving transistor Qd, the sensing line selection switch S_sw is maintained in the on state to receive the detection signal from the data line Dj, and the switches including the data line selection switch D_sw of the mode selector 560, the reset switch SWreset of the threshold voltage sensor 551 and the first switch SW1 and the second switch SW2 of the degradation sensor 553 are all maintained in the off state. Also, the first scanning signal Scan is applied with the low voltage Von, and the third scanning signal Em is applied with the high voltage Voff. In this state, the third switch SW3 included in the mobility sensor 552 is turned on and then the voltage of the node N1 is measured to calculate the mobility μ.

Next, a waveform in the frame interval when emitting light according to an input data voltage will be described with reference to FIG. 8.

FIG. 8 is a waveform diagram of a signal applied to emit light from the organic light emitting device shown in FIG. 2 in the frame interval of FIG. 6, wherein FIG. 8(A) is a waveform of a programming interval, FIG. 8(B) is a waveform of an emission interval, and FIG. 8(C) is a waveform of a black interval. In FIG. 8, the data voltage Vdat is applied through the data line Dj such that the sensing line selection switch S_sw is maintained in the off state and the data line selection switch D_sw is maintained in the on state.

That is, the first scanning signal Scan is applied with the low voltage Von in the programming interval of FIG. 8(A), and the data voltage Vdat is applied to the control terminal of the driving transistor Qd through the first switching transistor Qs1 and is stored to the capacitor Cst in FIG. 2. Here, even when the high voltage Voff is applied as the third scanning signal Em such that the driving transistor Qd is turned on such that the current $I_{LD}$ flows, the third switching transistor is maintained in the off state and thereby the current does not flow into the organic light emitting element OLED.

Next, the first scanning signal Scan is changed into the high voltage Voff in the emission interval of FIG. 8(B) and the third scanning signal Em is changed into the low voltage Von such that the current $I_{LD}$ emitted in the driving transistor Qd flows in the organic light emitting element OLED, and thereby the light is emitted.

Next, in the black interval of FIG. 8(C), the third scanning signal Em is again changed into the high voltage Voff such the current $I_{LD}$ does not flow in the organic light emitting element OLED, thereby displaying the black.

As above described, the input data is amended through the degree of degradation, the threshold voltage and the mobility measured in the turn-on interval, and then the data voltage is applied in the frame interval such that the display quality is improved. The amendment of the data will be described later.

Figure 9:
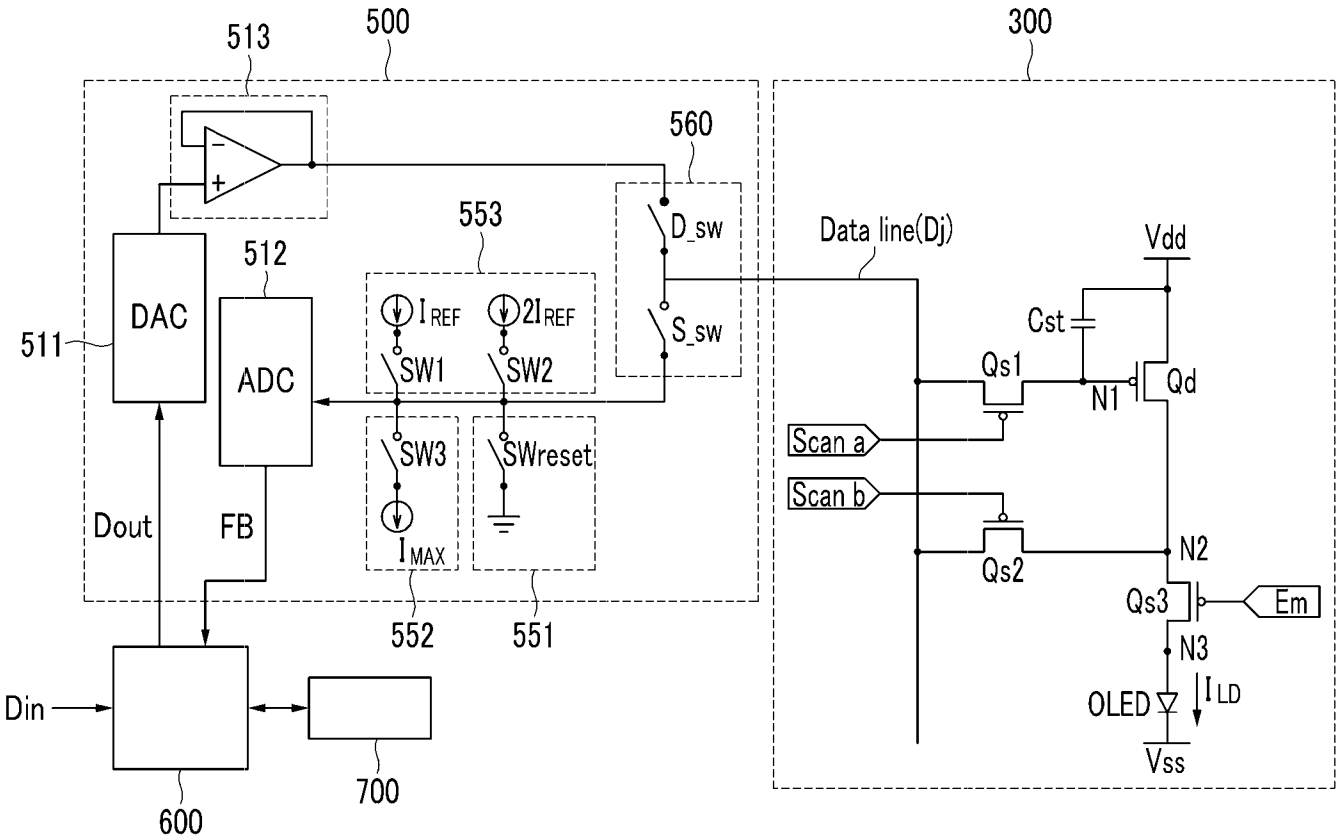
FIG. 9 shows an equivalent circuit diagram of a pixel in an organic light emitting device according to another exemplary embodiment of the present invention, along with a data driver, a signal controller, and a memory.

On the other hand, FIG. 9 shows a structure of a pixel according to another exemplary embodiment of the present invention.

FIG. 9 shows an equivalent circuit diagram of a pixel PX in an organic light emitting device according to another exemplary embodiment of the present invention, along with a data driver 500, a signal controller 600, and a memory 700.

In the circuit of FIG. 9, differently from the circuit of FIG. 2, the first switching transistor Qs1 and the second switching transistor Qs2 are controlled by different scanning signals. In this embodiment, the first switching transistor Qs1 is controlled by a first scanning signal Scan a and the second switching transistor Qs2 is controlled by a second scanning signal Scan b.

As shown in FIG. 9, the display pixel PX includes an organic light emitting element OLED, a driving transistor Qd, a capacitor Cst, and a first switching transistor Qs1, a second switching transistor Qs2 and a third switching transistor Qs3.

The driving transistor Qd has an output terminal, an input terminal, and a control terminal. The control terminal of the driving transistor Qd is connected to the capacitor Cst and the first switching transistor Qs1 at the node N1, the input terminal thereof is connected to the driving voltage Vdd, and the output terminal thereof is connected to the second switching transistor Qs2 and the third switching transistor Qs3 at the node N2.

A first terminal of the capacitor Cst is connected at the node N1 to the driving transistor Qd, and a second terminal thereof is connected to the driving voltage Vdd.

The first switching transistor Qs1 is operated in response to the first scanning signal Scan a, the second switching transistor Qs2 is operated in response to the second scanning signal Scan b, and the third switching transistor Qs3 is operated in response to the third scanning signal Em. The first switching transistor Qs1 is connected between the data line Dj and the node N1, the second switching transistor Qs2 is connected between the data line Dj and the node N2, and the third switching transistor Qs3 is connected between the anode (i.e., node N3) of the organic light emitting element OLED and the node N2.

In the present exemplary embodiment, the driving transistor Qd, and the first switching transistor Qs1, the second switching transistor Qs2 and the third switching transistor Qs3 are p-channel electric field effect transistors. An example of the electric field effect transistor can be a thin film transistor (TFT), and it may include polysilicon or amorphous silicon. A low voltage Von may turn on the first switching transistor Qs1, the second switching transistor Qs2 and the third switching transistor Qs3, and a high voltage Voff may turn off the first switching transistor Qs1, the second switching transistor Qs2 and the third switching transistor Qs3.

An anode of the organic light emitting element OLED is connected to the third switching transistor Qs3, and a cathode thereof is connected to the common voltage Vss. The organic light emitting element OLED displays images by emitting light and varying the intensity thereof according to the current $I_{LD}$ supplied by the driving transistor Qd through the third switching transistor Qs3, and the current $I_{LD}$ depends on the voltage between the control terminal and the input terminal of the driving transistor Qd.

The data driver 500 of FIG. 9 is the same as the data driver 500 of FIG. 2 such that additional description thereof is omitted.

Next, a method for measuring the threshold voltage Vth and mobility μ of the driving transistor Qd and the degradation of the organic light emitting element OLED will be described in the organic light emitting device according to an exemplary embodiment of FIG. 9.

Firstly, the method for measuring the degradation of the organic light emitting element OLED according to the exemplary embodiment of FIG. 9 has the same structure as the equivalent circuit shown in FIG. 3.

That is, the sensing line selection switch S_sw is maintained in the on state and the data line selection switch D_sw is maintained in the off state in the organic light emitting device of FIG. 9. Also, the reset switch SWreset of the threshold sensor 551 and the third switch SW3 of the mobility sensor 552 are maintained in the off state. Next, the first scanning signal Scan a, the second scanning signal Scan b, and the third scanning signal Em are applied with the low voltage Von. On the other hand, although a voltage is applied to the control terminal of the driving transistor Qd, the input terminal of the driving transistor Qd that was applied with the driving voltage Vdd is grounded for the driving transistor Qd to be maintained in the off state. The driving transistor Qd is operated by a voltage difference between the input terminal and the control terminal, but is not operated when the voltage of the control terminal is higher than the voltage of the input terminal. Therefore, if the input terminal voltage is grounded thereby decreasing the voltage, the voltage of the control terminal is higher than the voltage of the input terminal such that the driving transistor Qd is not operated.

Here, the first switch SW1 connected to the first current source $I_{REF}$ and the second switch SW2 connected to the second current source $2I_{REF}$ included in the degradation sensor 553 are sequentially operated. Thus, the current is applied from the current source such that a uniform current flows, and the voltage of the node N2 is measured at this time. To measure the voltages from two current sources involves calculating the voltage (the voltage of the node N3) of the anode of the organic light emitting element OLED from the voltage of the node N2. That is, in an exemplary embodiment of the present invention, the voltage of the node N2 is measured, and to actually measure the organic light emitting element OLED, the voltage (the voltage of the node N3) of the anode of the organic light emitting element OLED may be measured. However, in the present exemplary embodiment, it is necessary for the voltage drop generated in the third switching transistor Qs3 to be considered by measuring the voltage of the node N2, which is not the voltage of the node N3. Also, although the voltage of the second switching transistor Qs2 is slight, the voltage drop may be generated such that it is necessary to consider the second switching transistor Qs2. To calculate this voltage drop, at least two current sources are required. However, an additional current source may be further formed according to an exemplary embodiment, and it is established that the present exemplary embodiment has the reference current $I_{REF}$ and the reference current $2I_{REF}$ two times the reference current $I_{REF}$, but may have various current values.

As above-described, the degree of degradation of the organic light emitting element OLED is determined with reference to the voltage of the node N3 that is calculated by considering the voltage drop. That is, the degradation is determined by comparing the voltage of the node N3 and the luminance of the light emitted from the organic light emitting element OLED. This determination process may use the lookup table stored in the memory 700. Also, the degradation may be compensated when generating the luminance, and the compensation degree may be determined by using the lookup table.

On the other hand, in the exemplary embodiment of FIG. 9, a method for measuring the threshold voltage Vth of the driving transistor Qd will be described. In the exemplary embodiment of FIG. 9, the equivalent circuit diagram when measuring the threshold voltage Vth is the same as that of FIG. 4.

That is, in the organic light emitting device of FIG. 9, the sensing line selection switch S_sw is maintained in the on state, the data line selection switch D_sw is maintained in the off state, and the third switch SW3 of the mobility sensor 552, and the first switch SW1 and the second switch SW2 of the degradation sensor 553 regardless of the measurement of the threshold voltage Vth are maintained in the off state. Also, the first scanning signal Scan a and the second scanning signal Scan b are applied with the low voltage Von and the third scanning signal Em is applied with the high voltage Voff. Here, the driving transistor Qd is diode-connected. Here, the reset switch SWreset of the threshold voltage sensor 551 is turned on during a predetermined time and is turned off to measure the threshold voltage, that is, the voltage of the node N1. If the reset switch SWreset is turned on, the voltage of the node N1 is a ground as 0V, and if the reset switch SWreset is turned off, the voltage of the node N1 is slowly increased. After a predetermined time, the increasing of the voltage slows and the voltage of the node N1 approaches a constant value such that a voltage of a constant degree is represented. This approximately constant voltage is a value which is a difference between the threshold voltage Vth of the diode-connected driving transistor Qd and the driving voltage Vdd that is a voltage of the one terminal of the driving transistor Qd. Therefore, after the reset switch SWreset is turned off, if the voltage of the node N1 is measured after the predetermined time at which the driving transistor Qd arrives at the threshold voltage Vth, the threshold voltage Vth may be obtained by subtracting the voltage of the node N1 from the driving voltage Vdd.

Next, a method for measuring the mobility μ of the driving transistor Qd according to the exemplary embodiment of FIG. 9 will be described. An equivalent circuit diagram when measuring the mobility μ in the exemplary embodiment of FIG. 9 is the same as that of FIG. 5.

That is, in the organic light emitting device of FIG. 9, the sensing line selection switch S_sw is maintained in the on state, the data line selection switch D_sw is maintained in the off state, and the reset switch SWreset of the threshold voltage sensor 551 and the first switch SW1 and the second switch SW2 of the degradation sensor 553 regardless of the measurement of the mobility μ are maintained in the off state. Also, the first scanning signal Scan a and the second scanning signal Scan b are applied with the low voltage Von, and the third scanning signal Em is applied with the high voltage Voff. Here, the driving transistor Qd is diode-connected. Here, the voltage of the node N1 is measured in the state that the third switch SW3 of the mobility sensor 552 is turned on to constantly flow a maximum current $I_{MAX}$ outside such that the mobility μ may be obtained As above-described, measurements of the threshold voltage Vth, the mobility μ, and the degradation of the organic light emitting element OLED may be firstly executed in the turn-on interval. Also, in the frame interval, the measurements of the threshold voltage Vth, the mobility μ, and the degradation of the organic light emitting element OLED may not be executed, and only the operation of the display of the images is operated.

Figure 10:
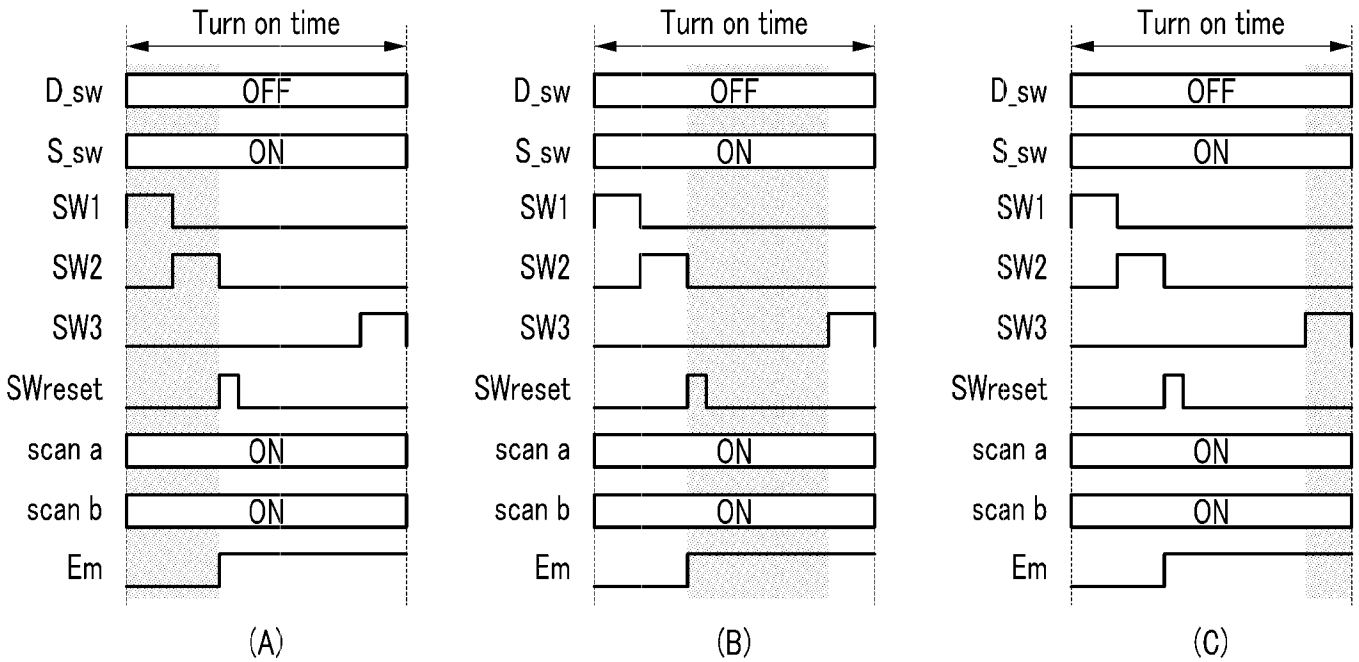
FIG. 10 is a waveform diagram of a signal applied when measuring degradation of the organic light emitting element, threshold voltage, and mobility through the exemplary embodiment of FIG. 9 in the turn-on interval.
Figure 11:
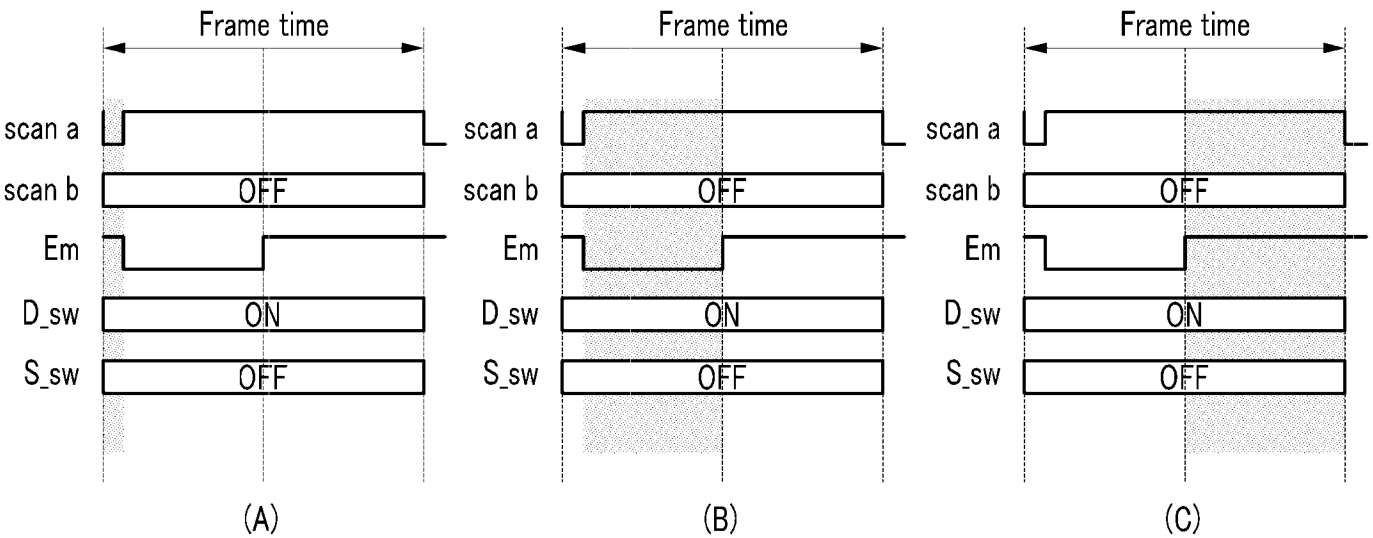
FIG. 11 is a waveform diagram of a signal applied to emit light from the organic light emitting device in the frame interval.

This content is shown through waveforms of FIG. 10 and FIG. 11.

FIG. 10 is a waveform diagram of a signal applied when measuring the degradation of the organic light emitting element OLED, the threshold voltage Vth, and the mobility μ through the exemplary embodiment of FIG. 9 in the turn-on interval, and FIG. 11 is a waveform diagram of a signal applied to emit light from the organic light emitting device in the frame interval.

Firstly, FIG. 10 will be described.

FIG. 10 is a waveform diagram of a signal applied when measuring the degradation of the organic light emitting element OLED of FIG. 9 and the threshold voltage Vth and the mobility μ of the driving transistor Qd in the turn-on interval. FIG. 10(A) shows the interval for measuring the degradation of the organic light emitting element OLED, FIG. 10(B) shows the interval for measuring the threshold voltage Vth, and FIG. 7(C) shows the interval for measuring the mobility μ.

Firstly, as shown in FIG. 10(A), to measure the degradation of the organic light emitting element OLED, the sensing line selection switch S_sw is maintained in the on state to receive the detection signal from the data line Dj, and the switches including the data line selection switch D_sw of the mode selector 560, the reset switch SWreset of the threshold voltage sensor 551 and the third switch SW3 of the mobility sensor 552 are maintained in the off state. Also, the first scanning signal Scan a and the second scanning signal Scan b are applied with the low voltage Von, and the third scanning signal Em is also applied with the low voltage Von. In this state, the first switch SW1 and the second switch SW2 included in the degradation sensor 553 are sequentially turned on to measure the voltages of the node N2 such that the voltage of the node N3 (i.e., the voltage of the anode of the organic light emitting element OLED) is calculated to determine the degradation of the organic light emitting element OLED. The determination of the existence of the degradation may be executed with reference to the lookup table stored in the memory 700.

On the other hand, as shown in FIG. 10(B), to measure the threshold voltage Vth of the driving transistor Qd, the sensing line selection switch S_sw is maintained in the on state to receive the detection signal from the data line Dj, and the switches including the data line selection switch D_sw of the mode selector 560, the third switch SW3 of the mobility sensor 552 and the first switch SW1 and the second switch SW2 of the degradation sensor 553 regardless of the measurement of the threshold voltage Vth are all maintained in the off state. Also, the first scanning signal Scan a and the second scanning signal Scan b are applied with the low voltage Von, and the third scanning signal Em is applied with the high voltage Voff. In this state, the reset switch SWreset included in the threshold voltage sensor 551 is temporary turned on and then turned off, and the voltage of the node N1 is measured after the passage of the time from the turn-off time to calculate the threshold voltage Vth.

Also, as shown in FIG. 10(C), to measure the mobility μ of the driving transistor Qd, the sensing line selection switch S_sw is maintained in the on state to receive the detection signal from the data line Dj, and the switches including the data line selection switch D_sw of the mode selector 560, the reset switch SWreset of the threshold voltage sensor 551 and the first switch SW1 and the second switch SW2 of the degradation sensor 553 regardless of the measurement of the mobility μ are all maintained in the off state. Also, the first scanning signal Scan a and the second scanning signal Scan b are applied with the low voltage Von, and the third scanning signal Em is applied with the high voltage Voff. In this state, the third switch SW3 included in the mobility sensor 552 is turned on and then the voltage of the node N1 is measured to calculate the mobility μ.

Next, a waveform in the frame interval when emitting light according to an input data voltage will be described with reference to FIG. 11.

FIG. 11 is a waveform diagram of a signal applied to emit light from the organic light emitting device shown in FIG. 9 in the frame interval of FIG. 6, wherein FIG. 11(A) is a waveform of a programming interval, FIG. 11(B) is a waveform of an emission interval, and FIG. 11(C) is a waveform of a black interval. In FIG. 11, the data voltage Vdat is applied through the data line Dj such that the sensing line selection switch S_sw is maintained in the off state and the data line selection switch D_sw is maintained in the on state.

That is, the first scanning signal Scan a is applied with the low voltage Von in the programming interval of FIG. 11(A), and the data voltage Vdat is applied to the control terminal of the driving transistor Qd through the first switching transistor Qs1 and is stored to the capacitor Cst in FIG. 9. Here, even when the second scanning signal Scan b and the third scanning signal Em are applied as the high voltage Voff and the driving transistor Qd is turned on such that the current $I_{LD}$ flows, the third switching transistor Qs3 is maintained in the off state and thereby the current does not flow into the organic light emitting element OLED.

Next, the first scanning signal Scan a is changed into the high voltage Voff in the emission interval of FIG. 11(B), and the third scanning signal Em is changed into the low voltage Von such that the current $I_{LD}$ emitted in the driving transistor Qd flows in the organic light emitting element OLED and thereby the light is emitted. Here, the second scanning signal Scan b is maintained at the high voltage Voff.

Next, in the black interval of FIG. 11(C), the third scanning signal Em is again changed into the high voltage Voff such the current $I_{LD}$ does not flow in the organic light emitting element OLED, thereby displaying the black. Here, the first scanning signal Scan a and the second scanning signal Scan b are maintained at the high voltage Voff.

As above-described, the input data is amended through the degree of degradation, the threshold voltage Vth and the mobility μ measured in the turn-on interval, and then the data voltage is applied in the frame interval such that the display quality is improved. The amendment of the input data will be described later.

The structure in which the data voltage Vdat is applied and the detection signal is received through the data line Dj is described above.

Next, a structure in which the sensing line and the data line are separated from each other will be described.

Figure 12:
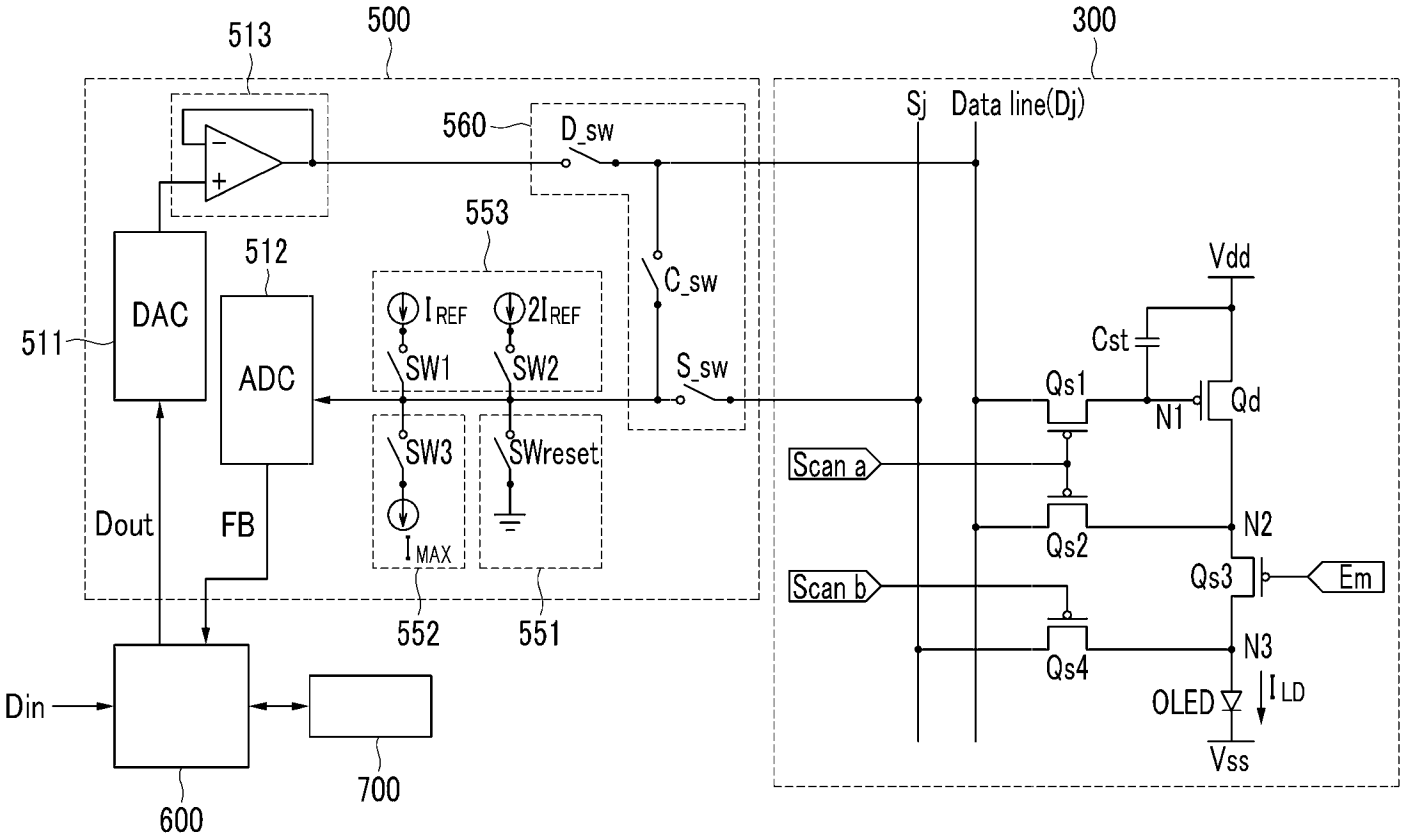
FIG. 12 shows an equivalent circuit diagram of a pixel in an organic light emitting device according to another exemplary embodiment of the present invention, along with a data driver, a signal controller and a memory.

FIG. 12 shows an equivalent circuit diagram of a pixel PX in an organic light emitting device according to another exemplary embodiment of the present invention, along with a data driver, a signal controller, and a memory.

Referring to FIG. 12, the organic light emitting device includes a display panel 300, a scan driver 400, a data driver 500, a signal controller 600, and a memory 700.

The display panel 300 includes a plurality of signal lines (not shown), a plurality of voltage lines (not shown), and a plurality of pixels PX connected thereto and substantially arranged as a matrix (FIG. 1).

The signal lines include a plurality of scanning signal lines to transmit scanning signals, a plurality of sensing lines Sj to transmit sensing data signals, and a plurality of data lines Dj to transmit data signals. The scanning signal lines are extended in approximately a row direction and are substantially parallel to each other, and the sensing lines and the data lines are extended in approximately a column direction and are substantially parallel to each other.

The voltage lines include a driving voltage line (not shown) to transmit a driving voltage.

As shown in FIG. 12, the pixel PX includes an organic light emitting element OLED, a driving transistor Qd, a capacitor Cst, and a first switching transistor Qs1, a second switching transistor Qs2, a third switching transistor Qs3 and a fourth switching transistor Qs4.

The driving transistor Qd has an output terminal, an input terminal, and a control terminal. The control terminal of the driving transistor Qd is connected at a node N1 to the capacitor Cst and the first switching transistor Qs1, the input terminal thereof is connected to the driving voltage Vdd, and the output terminal thereof is connected at a node N2 to the second switching transistor Qs2 and the third switching transistor Qs3.

A first terminal of the capacitor Cst is connected at the node N1 to the driving transistor Qd, and a second terminal thereof is connected to the driving voltage Vdd.

The first switching transistor Qs1 is operated in response to a first scanning signal Scan a, the second switching transistor Qs2 is operated in response to the first scanning signal Scan a, the third switching transistor Qs3 is operated in response to a third scanning signal Em, and the fourth switching transistor Qs4 is operated in response to a second scanning signal Scan b. The first switching transistor Qs1 is connected between the data line Dj and the node N1, the second switching transistor Qs2 is connected between the data line Dj and the node N2, the third switching transistor Qs3 is connected between the anode (i.e., node N3) of the organic light emitting element OLED and the node N2, and the fourth switching transistor Qs4 is connected between the sensing line Sj and the node N3.

In the present exemplary embodiment, the driving transistor Qd and the first switching transistor Qs1, the second switching transistor Qs2, the third switching transistor Qs3 and the fourth switching transistor Qs4 are p-channel electric field effect transistors. An example of the electric field effect transistor can be a thin film transistor (TFT), and it may include polysilicon or amorphous silicon. A low voltage Von may turn on the first switching transistor Qs1, the second switching transistor Qs2, the third switching transistor Qs3 and the fourth switching transistor Qs4, and a high voltage Voff may turn off the first switching transistor Qs1, the second switching transistor Qs2, the third switching transistor Qs3 and the fourth switching transistor Qs4.

An anode of the organic light emitting element OLED is connected to the third switching transistor Qs3, and a cathode thereof is connected to the common voltage Vss. The organic light emitting element OLED displays images by emitting light and varying the intensity thereof according to the current $I_{LD}$ supplied by the driving transistor Qd through the third switching transistor Qs3, and the current $I_{LD}$ depends on the voltage between the control terminal and the input terminal of the driving transistor Qd.

The data driver 500 of FIG. 12 is similar to the data driver of FIG. 2. However, three switches S_sw, D_sw, and C_sw for controlling the connection with the data line Dj or the sensing line Sj are formed in the present embodiment illustrated in FIG. 12. That is, the data driver 500 further includes a mode selector 560, and the mode selector 560 includes a data line selection switch D_sw for the data driver 500 to apply the data voltage Vdat to the data line, a sensing line selection switch S_sw for the data driver 500 to receive the sensing data signal SEN through the detection signal line, and a connection switch C_sw for connecting the detection signal line and the data line.

Basically, the data driver 500 includes a digital-to-analog converter 511, an analog-to-digital converter 512, and an OP amplifier 513. The digital-to-analog converter 511 receives digital output image signals Dout of the display pixels PX for each row to convert them into analog voltages and to apply the converted analog voltages to the OP amplifier 513 such that the OP amplifier 513 amplifies the converted analog voltages into non-inversion signals and applies them to the data lines $D_1$-$D_m$ as analog data voltages Vdat. On the other hand, the analog-to-digital converter 512 receives sensing data signals from each display pixel PX through the sensing lines Sj and converts and outputs them as digital values FB.

Further, the data driver 500 includes a threshold voltage sensor 551 sensing a threshold voltage, a mobility sensor 552 sensing a mobility, and a degradation sensor 553 sensing the degradation of the organic light emitting element OLED.

Next, a method for measuring a threshold voltage (Vth), mobility (μ), and degradation of an organic light emitting element OLED will be described in the organic light emitting device according to an exemplary embodiment of FIG. 12.

Figure 13:
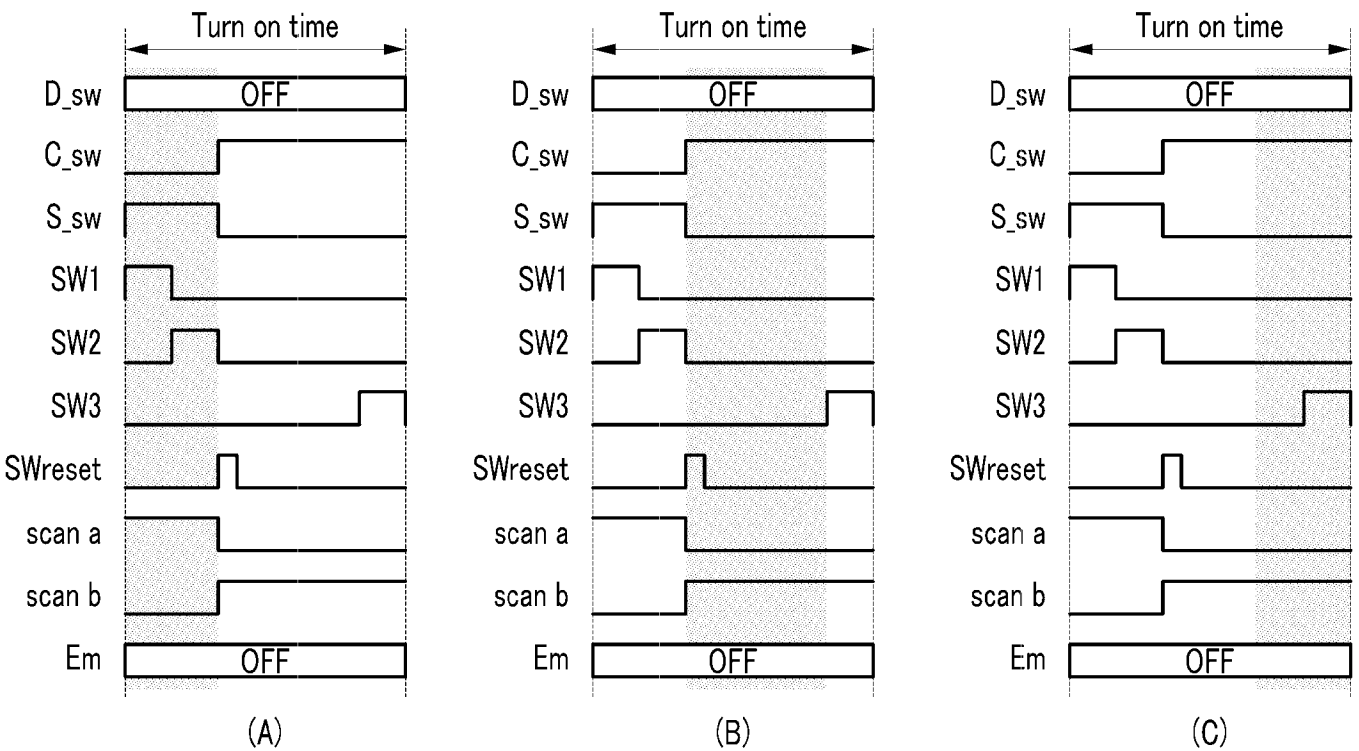
FIG. 13 is a waveform diagram of a signal applied when measuring degradation of the organic light emitting element, and a threshold voltage and mobility of the driving transistor, through the exemplary embodiment of FIG. 12 in the turn-on interval.

Firstly, FIG. 13 shows the case of degradation of the organic light emitting element OLED and a threshold voltage Vth and a mobility μ of the driving transistor Qd being measured together through the exemplary embodiment of FIG. 12 in the turn-on interval.

Figure 14:
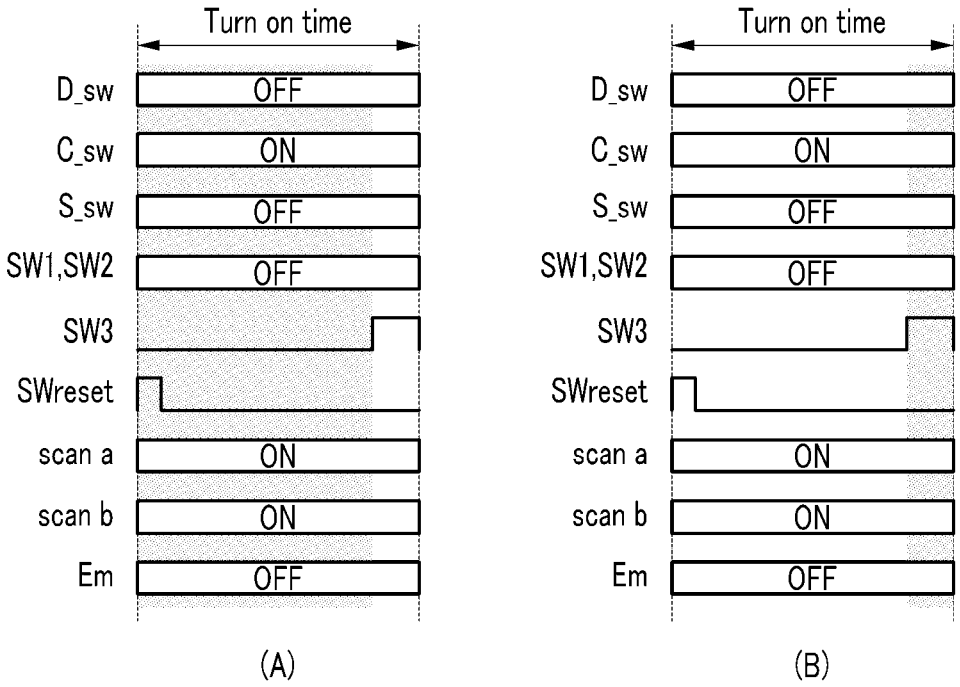
FIG. 14 is a waveform diagram of a signal applied when measuring a threshold voltage and mobility of a driving transistor through the exemplary embodiment of FIG. 12 in the turn-on interval.
Figure 15:
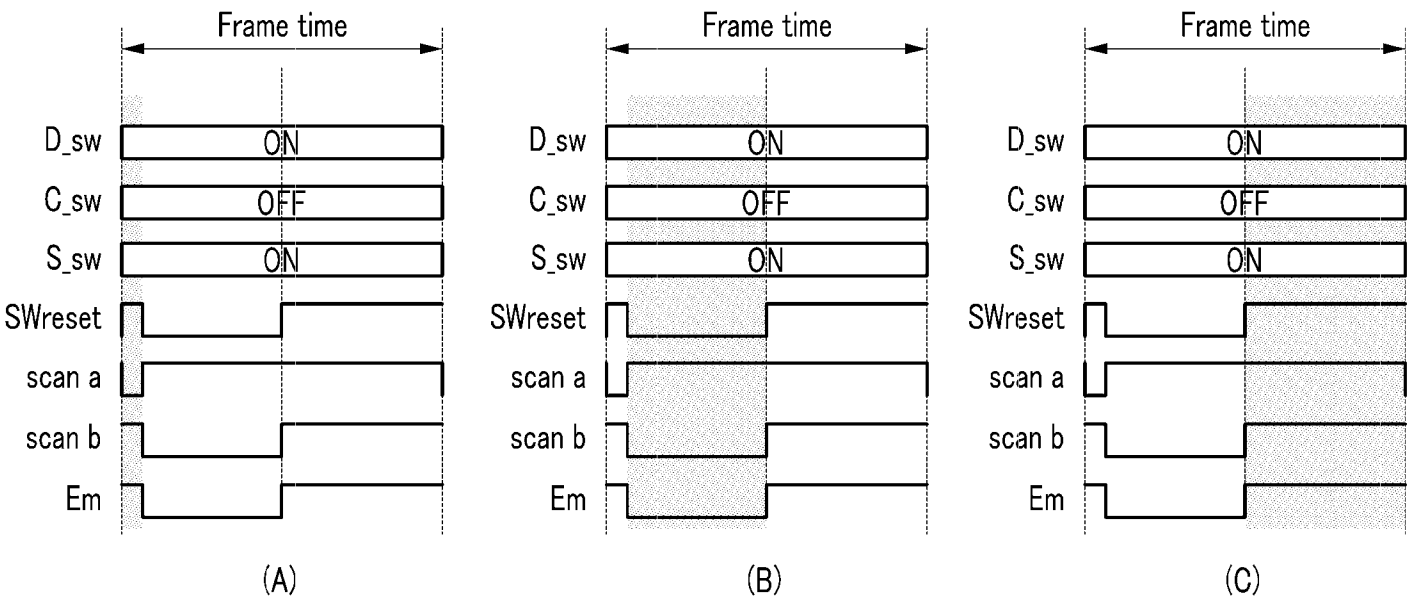
FIG. 15 is a waveform diagram of a signal to emit light from an organic light emitting device and to measure degradation of an organic light emitting element through the exemplary embodiment of FIG. 12 in the frame interval.

On the other hand, FIG. 14 and FIG. 15 show the case where the threshold voltage Vth and the mobility μ of the driving transistor Qd are measured in the turn-on interval, and the emission of the pixel and the degradation of the organic light emitting element OLED are measured in the frame interval.

Firstly, FIG. 13, in which the degradation of the organic light emitting element OLED and the threshold voltage Vth and the mobility μ of the driving transistor Qd are measured together, will be described.

FIG. 13 is a waveform diagram of a signal applied when measuring the degradation of the organic light emitting element OLED and the threshold voltage Vth and the mobility p of the driving transistor Qd through the exemplary embodiment of FIG. 12 in the turn-on interval.

As a waveform diagram of a signal applied when measuring degradation of the organic light emitting element OLED and a threshold voltage Vth and mobility μ of the driving transistor Qd through the exemplary embodiment of FIG. 12 in the turn-on interval, FIG. 13(A) represents an interval for measuring the degradation of the organic light emitting element OLED, FIG. 13(B) represents an interval for measuring the threshold voltage Vth of the driving transistor Qd, and FIG. 13(C) represents an interval for measuring the mobility μ of the driving transistor Qd.

Firstly, as shown in FIG. 13(A), to measure the degradation of the organic light emitting element OLED, the sensing line selection switch S_sw is maintained in the on state, the connection switch C_sw and the data line selection switch D_sw are maintained in the off state, and the switches included in the threshold voltage sensor 551 and the mobility sensor 552 are all be maintained in the off state. Also, the first scanning signal Scan a and the third scanning signal Em are applied with the high voltage Voff, and the second scanning signal Scan b is applied with the low voltage Von. In this state, the first switch SW1 and the second switch SW2 included in the degradation sensor 553 are sequentially turned on to measure the voltages of the node N3 (i.e., the voltage of the anode of the organic light emitting element OLED) to determine the degradation of the organic light emitting element OLED. The determination of the existence of the degradation may be executed with reference to the lookup table stored at the memory 700.

On the other hand, as shown in FIG. 13(B), to measure the threshold voltage Vth of the driving transistor Qd, the connection switch C_sw is maintained in the on state, the data line selection switch D_sw and the sensing line selection switch S_sw are maintained in the off state, and the switches included in the mobility sensor 552 and the switches included in the degradation sensor 553 regardless of the measurement of the threshold voltage Vth are maintained in the off state. Also, the first scanning signal Scan a is applied with the low voltage Von, and the second scanning signal Scan b and the third scanning signal Em are applied with the high voltage Voff. In this state, the reset switch SWreset included in the threshold voltage sensor 551 is temporary turned on and then turned off, and the voltage of the node N1 is measured to calculate the threshold voltage Vth.

Also, as shown in FIG. 13(C), to measure of the mobility μ of the driving transistor Qd, the connection switch C_sw is maintained in the on state, the data line selection switch D_sw and the sensing line selection switch S_sw are maintained in the off state, and the reset switch SWreset of the threshold voltage sensor 551 regardless of the measurement of the mobility μ and the switches included in the degradation sensor 553 are all maintained in the off state. Also, the first scanning signal Scan a is applied with the low voltage Von, and the second scanning signal Scan b and the third scanning signal Em are applied with the high voltage Voff. In this state, the third switch SW3 included in the mobility sensor 552 is turned on and then the voltage of the node N1 is measured to calculate the mobility μ.

Next, the case that the threshold voltage Vth and the mobility μ of the driving transistor Qd are measured in the turn-on interval and the emission of the pixel PX and the degradation of the organic light emitting element OLED are measured in the frame interval will be described with reference to FIG. 14 and FIG. 15.

FIG. 14 is a waveform diagram of a signal applied when measuring the threshold voltage Vth and the mobility μ of the driving transistor Qd through the exemplary embodiment of FIG. 12 in the turn-on interval. FIG. 15 is a waveform diagram of a signal to emit light from the organic light emitting device and to measure the degradation of the organic light emitting element OLED through the exemplary embodiment of FIG. 12 in the frame interval.

FIG. 14(A) represents an interval for measuring the threshold voltage Vth, and FIG. 14(B) represents an interval for measuring the mobility μ.

That is, when measuring the threshold voltage Vth and the mobility μ in the turn-on interval, the connection switch C_sw is maintained in the on state, the data line selection switch D_sw and the sensing line selection switch S_sw are maintained in the off state, and the first switch SW1 and the second switch SW2 of the degradation sensor 553 regardless of the measurement of the threshold voltage Vth and the mobility μ are maintained in the off state. Further, the first scanning signal Scan a and the second scanning signal Scan b are applied with the low voltage Von, and the third scanning signal Em is applied with the high voltage Voff.

In this state, in FIG. 14(A) of measuring the threshold voltage Vth, the reset switch SWreset of the threshold voltage sensor 551 is turned on during the predetermined time and then is turned off to measure the threshold voltage after the time that the driving transistor Qd arrives at the threshold voltage Vth. Here, the third switch SW3 of the mobility sensor 552 is maintained in the off state.

On the other hand, the third switch SW3 of the mobility sensor 552 is turned on to measure the mobility μ (FIG. 14(B)). Here, the reset switch SWreset of the threshold voltage sensor 551 is maintained in the off state.

In this state, the threshold voltage Vth and the mobility μ may be obtained by using the voltage of the node N1 of FIG. 12.

In the present exemplary embodiment, the measuring of the threshold voltage Vth is executed before the measuring of the mobility μ however the measuring of the mobility μ may be executed first.

On the other hand, the measuring of the degradation of the organic light emitting element OLED in the frame interval shown in FIG. 15 will be described. In the frame interval, the connection switch C_sw is maintained in the off state, and the data line selection switch D_sw and the sensing line selection switch S_sw are maintained in the on state.

In the programming interval of FIG. 15(A), the first scanning signal Scan a is applied with the low voltage Von, and the reset switch SWreset of the threshold voltage sensor 551 is turned on. The first scanning signal Scan a prepares the emission interval, and turning on the reset switch SWreset prevents the emission luminance from being changed due to the current flow to the organic light emitting element OLED on the sensing line Sj when measuring the degradation of the organic light emitting element OLED by removing the charges that may be generated on the sensing line Sj. The charges are removed through connection to ground. Here, the second scanning signal Scan b and the third scanning signal Em are applied with the high voltage Voff.

Next, the second scanning signal Scan b and the third scanning signal Em are applied with the low voltage Von that is changed from the high voltage Voff in the step of FIG. 15(B). The third scanning signal Em is a signal for the current $I_{LD}$ to flow to the organic light emitting element OLED to emit the light, however the second scanning signal Scan b measures the degradation of the organic light emitting element OLED by measuring the voltage applied to the node N3. Here, the first scanning signal Scan a is applied with the high voltage Voff.

Next, in the interval of FIG. 15(C), the high voltage Voff that is changed from the low voltage Von and is applied to the second scanning signal Scan b and the third scanning signal Em. As a result, the organic light emitting element OLED does not emit light and displays black. Also, the reset switch SWreset is turned on to remove the charges on the sensing line Sj that perhaps may be generated (the charges are removed by connecting to ground). Turning on the reset switch SWreset may be omitted according to an exemplary embodiment.

The method for measuring degradation of the organic light emitting element in the programming and emission intervals has been described through FIG. 15.

Figure 16:
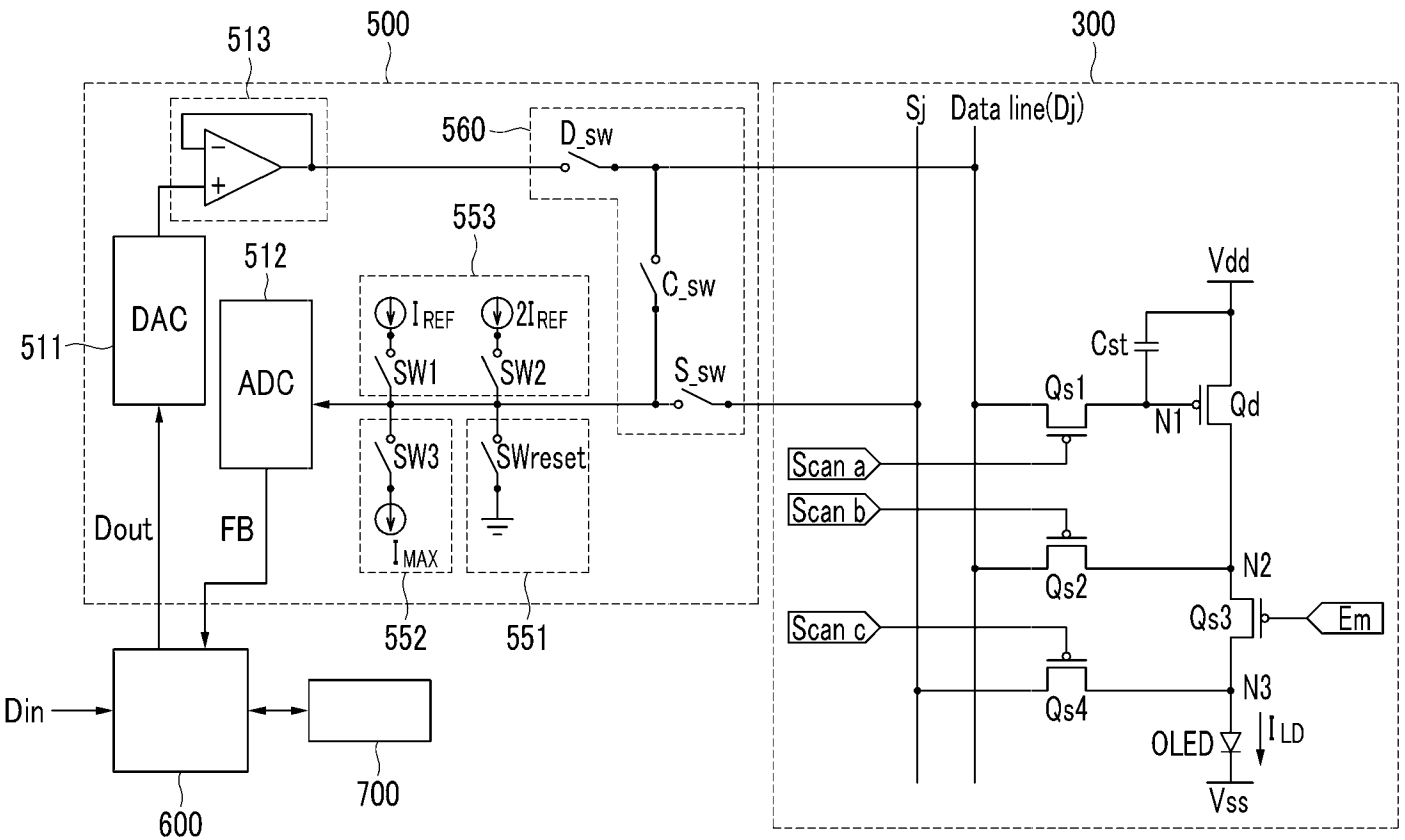
FIG. 16 shows an equivalent circuit diagram of a pixel in an organic light emitting device according to another exemplary embodiment of the present invention, along with a data driver, a signal controller, and a memory.

On the other hand, FIG. 16 shows another exemplary embodiment that is changed from the exemplary embodiment of FIG. 12.

FIG. 16 shows an equivalent circuit diagram of a pixel PX in an organic light emitting device according to another exemplary embodiment of the present invention, along with a data driver 500, a signal controller 600, and a memory 700.

Differently from FIG. 12, in FIG. 16, the first scanning signal Scan a controlling the first switching transistor Qs1 and the second Scanning signal Scan b controlling the second switching transistor Qs2 are separated from each other. The first scanning signal Scan a and the second scanning signal Scan b may be applied with different signals from each other due to this difference. When applying the different signals, it is not necessary that the second switching transistor Qs2 is turned on when the first switching transistor Qs1 is turned on in the frame interval. On the other hand, it is preferable that the first switching transistor Qs1 and the second switching transistor Qs2 are turned on in the turn-on interval.

For reference, the third scanning signal Em controls the third switching transistor Qs3 and the fourth scanning signal Scan c controlling the fourth switching transistor Qs4 is indicated as Scan c in FIG. 16.

The methods for measuring the degradation of the organic light emitting element OLED, and the threshold voltage Vth and the mobility μ of the driving transistor Qd have been described for each exemplary embodiment.

Next, a method for amending a data voltage Vdat applied to a pixel will be described by using the measured degradation of the organic light emitting element OLED, and the threshold voltage Vth and the mobility μ of the driving transistor Qd.

The above-described Equation 2 is a relationship for the current flowing in the driving transistor Qd. Here, the applied current I is a value that is changed by a gray value and the degradation degree of the organic light emitting element OLED, and the maximum current $I_{MAX}$ is represented by Equation 5 under the consideration of the value.

$$\frac{100}{\alpha} \times \frac{GV}{2^n - 1} \times I_{MAX} = \frac{1}{2}\mu C_{ox}\frac{W}{L}(V_{dd} - V_G - |V_{th}|)^2 \quad \text{[Equation 5]}$$

Here, GV is a gray value.

Here, the gray value is an integer from 0 to $2^{n-1}$, n is a bit number of an input image signal, and the gray value is a value from 0 to 255 if the bit number n of the input image signal is 8. α is a value representing the degradation degree of the organic light emitting element OLED, and the value may be output from the lookup table stored in the memory 700 according to the voltage sensed by measuring the degradation of the organic light emitting element OLED.

Equation 5 may be summarized with reference to $V_G$ as Equation 6.

$$V_G = V_{dd} - |V_{th}| - \sqrt{\frac{100}{\alpha}} \times \sqrt{\frac{GV}{2^n - 1}} \times \sqrt{\frac{2I_{MAX} \times L}{\mu C_{ox} \times W}} \quad \text{[Equation 6]}$$

Here, GV is a gray value.

Equation 1 and Equation 4 may be reflected to Equation 5 as Equation 7.

$$V_G = V_N - \sqrt{\frac{100}{\alpha}} \times \sqrt{\frac{\text{data}}{2^n - 1}} (V_N - V_{GMAX}) \quad \text{[Equation 7]}$$

Here, $V_N$, $V_{GMAX}$, and α are values stored to the memory through the measuring of the threshold voltage Vth of the driving transistor Qd, the mobility μ of the driving transistor Qd, and the degradation of the OLED. Therefore, $V_G$ may be obtained according to the gray value of the input data, and the data voltages are generated according to the $V_G$ values to apply them to the data lines. As a result, the input data is amended and applied to the pixel based on the characteristic of each pixel of the display device and thereby the quality of the display is improved, and the characteristic difference between the pixels is removed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a data driver;

a plurality of data lines connected to the data driver; and a pixel connected to each data line, the pixel to display an image, wherein the pixel comprises:

a light-emitting element comprising a first terminal and a second terminal;

a driving transistor to output a driving current to drive the light-emitting element, the driving transistor comprising a control terminal, an input terminal, and an output terminal;

a first switching transistor controlled by a first scanning signal, connected between the respective data line and the control terminal of the driving transistor, and connected directly to the respective data line;

a second switching transistor controlled by a second scanning signal, and connected between the respective data line and the output terminal of the driving transistor;

a third switching transistor controlled by a third scanning signal, and connected between the output terminal of the driving transistor and the first terminal of the light-emitting element; and a capacitor connected between the control terminal of the driving transistor and a driving voltage terminal, wherein the data driver is configured to apply a data voltage to the pixel through the respective data line, and the data driver comprises a mode selector to select to receive a sensing data voltage from the pixel.

2. The display device of claim 1, wherein the mode selector comprises a data line selection switch and a sensing line selection switch.

3. The display device of claim 2, wherein the data driver comprises a threshold voltage sensor to determine a threshold voltage of the driving transistor, a mobility sensor to determine a mobility of the driving transistor, and a degradation sensor to determine a degradation of the light-emitting element.

4. The display device of claim 3, wherein the threshold voltage sensor, the mobility sensor, and the degradation sensor are connected to the sensing line selection switch.

5. The display device of claim 4, wherein the threshold voltage sensor comprises a ground terminal and a first switch controlling on/off between the ground terminal and the data line, the mobility sensor comprises a current source to apply the same current as the maximum current applied to the driving transistor and a second switch for controlling on/off between the current source and the data line, and the degradation sensor comprises at least two current sources connected to a third switch and a fourth switch, respectively, the third switch and fourth switch to control on/off between the respective current source and the data line.

6. The display device of claim 5, wherein the threshold voltage sensor determines the threshold voltage through the voltage of the control terminal of the driving transistor by turning on the first switch during a time and turning it off in the state that the sensing line selection switch is maintained in the on state, the data line selection switch is maintained in the off state, the third scanning signal is applied with an off voltage, and the first scanning signal and the second scanning signal are applied with an on voltage.

7. The display device of claim 5, wherein the mobility sensor determines the mobility through the voltage of the control terminal of the driving transistor by turning on the second switch in the state that the sensing line selection switch is maintained in the on state, the data line selection switch is maintained in the off state, the third scanning signal is applied with the off voltage, and the first scanning signal and the second scanning signal are applied with the on voltage.

8. The display device of claim 5, wherein the degradation sensor determines the degradation degree of the light-emitting element by using two voltages determined from the output terminal of the driving transistor in the state that the sensing line selection switch is maintained in the on state, the data line selection switch is maintained in the off state, the first scanning signal, the second scanning signal and the third scanning signal are applied with the on voltage, the third switch and the fourth switch are sequentially turned on, the first switch and the second switch are maintained in the off state, and the voltages of the output terminal of the driving transistor are determined.

9. The display device of claim 5, wherein the threshold voltage sensor, the mobility sensor, and the degradation sensor are operated in a turn-on interval from the time that the display device is turned on to the time that the pixel displays the images.

10. The display device of claim 1, wherein the first scanning signal and the second scanning signal are the same signal.

11. The display device of claim 5, further comprising a plurality of sensing lines connected to the data driver, wherein the pixel further comprises a fourth switching transistor controlled by a fourth scanning signal, and the fourth switching transistor is connected between the first terminal of the light-emitting element and the respective sensing line.

12. The display device of claim 11, wherein the mode selector further comprises a control switch disposed between the data line selection switch and the sensing line selection switch, and the control switch controls the disconnection between the data line and the sensing line.

13. A method for driving a display device comprising a display panel comprising a pixel comprising a driving transistor and a light-emitting element, and a data line connected to the pixel, the method comprising:

executing at least one of determining a threshold voltage of the driving transistor, determining a mobility of the driving transistor, and determining a degradation of the light-emitting element;

amending and converting an input data into a data voltage based on the determined result to apply the data voltage to the pixel through the respective data line, wherein the data line is used to determine the voltage in the determination of the threshold voltage and the mobility of the driving transistor, and the degradation of the light-emitting element; and executing a turn-on interval after turning on the display device before displaying the images of the pixel and a frame interval displaying the image of the pixel, wherein the frame interval comprises an emission interval displaying the images according to the input data voltage, a programming interval preparing the emission interval, and a black interval displaying the black regardless of the voltage input to the pixel, wherein determining the threshold voltage of the driving transistor and the mobility of the driving transistor is executed in the turn-on interval, and wherein determining the degradation of the light-emitting element is executed in the emission interval in which the light-emitting element emits light.

14. A method for driving a display device comprising a display panel comprising a pixel comprising a driving transistor and a light-emitting element, and a data line connected to the pixel, the method comprising:

executing at least one of determining a threshold voltage of the driving transistor, determining a mobility of the driving transistor, and determining a degradation of the light-emitting element; and amending and converting an input data into a data voltage based on the determined result to apply the data voltage to the pixel through the respective data line, wherein the data line is used to determine the voltage in the determination of the threshold voltage and the mobility of the driving transistor, and the degradation of the light-emitting element, wherein the display device further comprises a data driver connected to the data line, wherein the pixel further comprises:

the driving transistor outputting a driving current driving the light-emitting element, and comprising a control terminal, an input terminal, and an output terminal, a first switching transistor controlled by a first scanning signal, and connected between the data line and the control terminal of the driving transistor, a second switching transistor controlled by a second scanning signal, and connected between the data line and the output terminal of the driving transistor, a third switching transistor controlled by a third scanning signal, and connected between the output terminal of the driving transistor and a first terminal of the light-emitting element, and a capacitor connected between the control terminal of the driving transistor and a driving voltage terminal, and wherein, in determining the threshold voltage, the data driver is input with the voltage of the control terminal of the driving transistor through the data line in a state that the third scanning signal is applied with an off voltage, and the first scanning signal and the second scanning signal are applied with an on voltage.

15. A method for driving a display device comprising a display panel comprising a pixel comprising a driving transistor and a light-emitting element, and a data line connected to the pixel, the method comprising:

executing at least one of determining a threshold voltage of the driving transistor, determining a mobility of the driving transistor, and determining a degradation of the light-emitting element; and amending and converting an input data into a data voltage based on the determined result to apply the data voltage to the pixel through the respective data line, wherein the data line is used to determine the voltage in the determination of the threshold voltage and the mobility of the driving transistor, and the degradation of the light-emitting element, wherein the display device further comprises a data driver connected to the data line, wherein the pixel further comprises:

the driving transistor outputting a driving current driving the light-emitting element, and comprising a control terminal, an input terminal, and an output terminal, a first switching transistor controlled by a first scanning signal, and connected between the data line and the control terminal of the driving transistor, a second switching transistor controlled by a second scanning signal, and connected between the data line and the output terminal of the driving transistor, a third switching transistor controlled by a third scanning signal, and connected between the output terminal of the driving transistor and a first terminal of the light-emitting element, and a capacitor connected between the control terminal of the driving transistor and a driving voltage terminal, and wherein, in determining the mobility, the data driver is input with the voltage of the control terminal of the driving transistor through the data line in the state that the third scanning signal is applied with an off voltage, and the first scanning signal and the second scanning signal are applied with an on voltage.

16. A method for driving a display device comprising a display panel comprising a pixel comprising a driving transistor and a light-emitting element, and a data line connected to the pixel, the method comprising:

executing at least one of determining a threshold voltage of the driving transistor, determining a mobility of the driving transistor, and determining a degradation of the light-emitting element; and amending and converting an input data into a data voltage based on the determined result to apply the data voltage to the pixel through the respective data line, wherein the data line is used to determine the voltage in the determination of the threshold voltage and the mobility of the driving transistor, and the degradation of the light-emitting element, wherein the display device further comprises a data driver connected to the data line, wherein the pixel further comprises:

the driving transistor outputting a driving current driving the light-emitting element, and comprising a control terminal, an input terminal, and an output terminal, a first switching transistor controlled by a first scanning signal, and connected between the data line and the control terminal of the driving transistor, a second switching transistor controlled by a second scanning signal, and connected between the data line and the output terminal of the driving transistor, a third switching transistor controlled by a third scanning signal, and connected between the output terminal of the driving transistor and a first terminal of the light-emitting element, and a capacitor connected between the control terminal of the driving transistor and a driving voltage terminal, and wherein, in determining the degradation, the data driver is input with the voltage of the output terminal of the driving transistor through the data line in the state that the third scanning signal, the first scanning signal, and the second scanning signal are applied with an on voltage.

* * * * *